US006046396A

United States Patent [19]

Miyamoto

[11] Patent Number: 6,046,396

[45] Date of Patent: Apr. 4, 2000

[54] STRINGED MUSICAL INSTRUMENT PERFORMANCE INFORMATION COMPOSING APPARATUS AND METHOD

[75] Inventor: Hiromu Miyamoto, Hamamatsu, Japan

[73] Assignee: Yamaha Corporation, Hamamatsu, Japan

[21] Appl. No.: 09/382,213

[22] Filed: Aug. 24, 1999

[30] Foreign Application Priority Data

Aug. 25, 1998 [JP] Japan ..... 10-239147

[51] Int. Cl.[7] ..... G10H 1/38

[52] U.S. Cl. ..... 84/613; 84/637; 84/650; 84/669; 84/DIG. 22

[58] Field of Search ..... 84/611–613, 635–637, 84/650–652, 667–669, 713–715, DIG. 22

[56] References Cited

U.S. PATENT DOCUMENTS

| | | | |
|---|---|---|---|
| 5,597,971 | 1/1997 | Saito | 84/669 |
| 5,705,761 | 1/1998 | Minamitaka | 84/609 |
| 5,723,803 | 3/1998 | Kurakake . | |
| 5,777,251 | 7/1998 | Hotta et al. | 84/609 |
| 5,900,567 | 5/1999 | Fay et al. | 84/613 |

FOREIGN PATENT DOCUMENTS 10-105173 4/1998 Japan .

*Primary Examiner*—Robert E. Nappi
*Assistant Examiner*—Marlon T. Fletcher
*Attorney, Agent, or Firm*—Graham & James LLP

[57] ABSTRACT

The apparatus and method composes performance information which represents a musical performance on a stringed instrument having a plurality of strings, each string being capable of generating a tone having a pitch which is selectively assigned to each string from among plural pitches available on each string. Upon designation of a chord to be played, the pitches of tones to be respectively assigned to the plurality of strings are determined such that the tones of the determined pitches constitute the designated chord. Then the strings to be assigned for tone generation are designated from among the plurality of strings, and the timing at which the assigned tone is to be generated is designated for each of the designated strings. The data of the tones having the determined pitches are generated, in which the data of each tone represents the tone generation on the designated string and at the designated timing. The designation of the strings and the timings for tone generation may be done by means of individual designating keys or sample templates having predetermined designation parameters.

6 Claims, 14 Drawing Sheets

Hardware Configuration

Hardware Configuration

Functional Blocks Outline

Basic Table of Constituent Notes BT

| CV | CH | TC (SRn ; Nn ; FRn) |
|---|---|---|
| Lo | Cmaj | 1st String ; E4 ; 0th Fret |
| Hi | Cmin | 2nd String ; C4 ; 1st Fret |
| | : | 3rd String ; G3 ; 0th Fret |
| | C #maj | 4th String ; E3 ; 2nd Fret |
| | : | 5th String ; C3 ; 3rd Fret |
| | | 6th String ; E2 ; 0th Fret |

User Table of Constituent Notes UT

| CV | CH | TC |
|---|---|---|
| Usr | — — | — — |

Screen Format

Template Structure
(Each Template Is for One to Several Measures)

Cutting Template

Arpeggio Template

Performance Info Structure

Music Position Designating Mode (1)

(Step−by−Step Recording Mode (1))

Music Position Designating Mode (1)

(Step-by-Step Recording Mode (1))

Music Position Designating Mode (2)

Step-by-Step Recording Mode (2)

Real-Time Recording Mode (1)

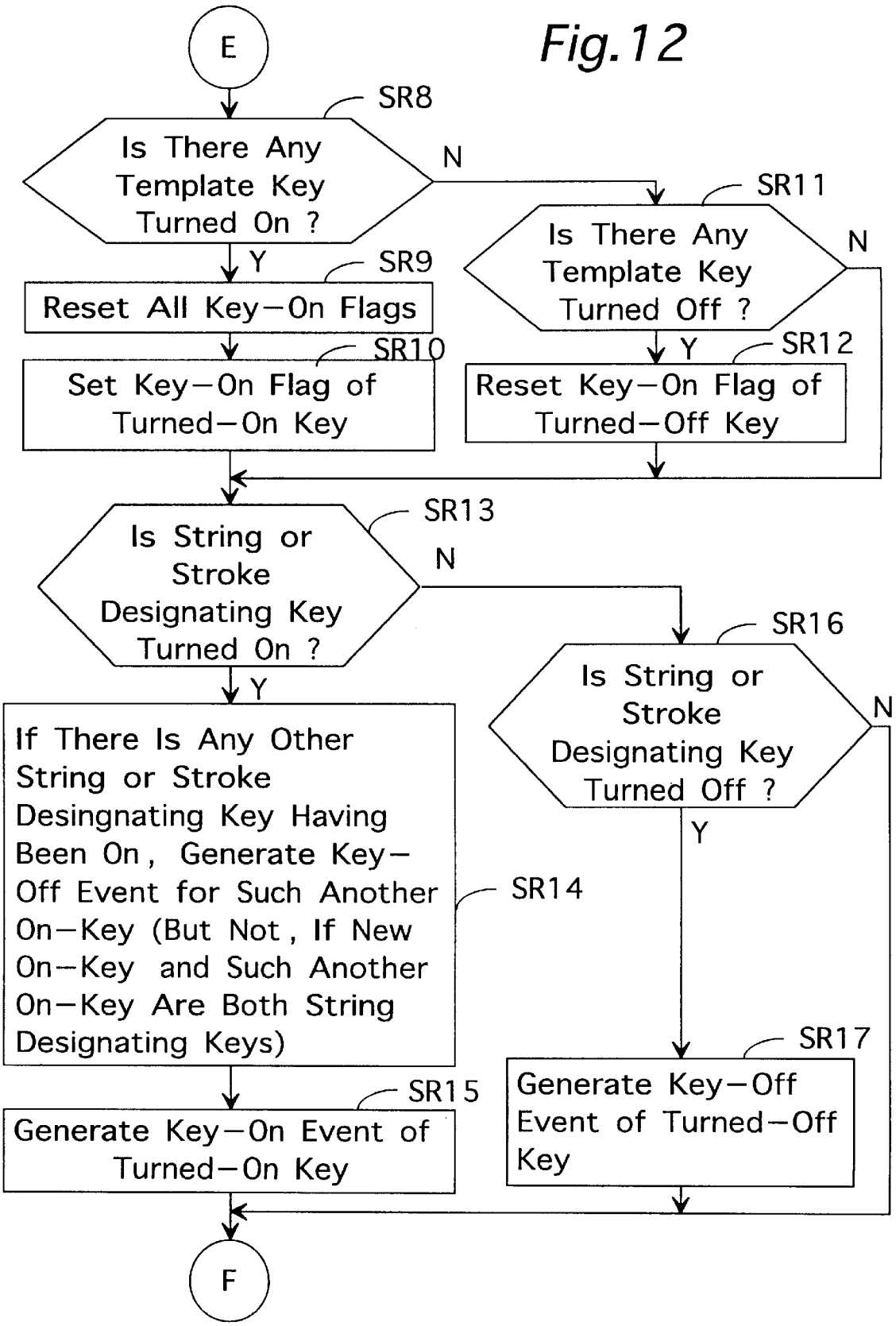
Real-Time Recording Mode (2)

Timer Interrupt Processing

Timer Interrupt Processing

STRINGED MUSICAL INSTRUMENT PERFORMANCE INFORMATION COMPOSING APPARATUS AND METHOD

BACKGROUND OF THE INVENTION

1. Field of the Invention

The present invention relates to a musical performance information composing apparatus and method, and a machine readable medium containing program instructions for realizing such an apparatus and a method using a computer system, and more particularly to an apparatus and a method capable of composing a musical performance information of a polychord stringed instrument such as a guitar having six strings, wherein the performance information is capable of playing back a musical performance which will give a musically natural feeling as if played on an actual stringed instrument.

2. Description of the Prior Art

In order to realize realistic performance sounds of the stringed instrument having a plurality of strings (i.e. a polychord) such as the guitar, the double bass, the ukulele and the mandolin through an electronic appliance based on electronic information signals, the performance information should carry features and characteristics peculiar to the playing manners and the voicing (harmonization) on such musical instruments. For example, with respect to the guitar, the performance information should contain information (data signals) of unique guitar tones under such performances as the stroke performance and the arpeggio performance which are peculiar to the guitar and of unique guitar voicing produced under such performances. Among conventionally known or utilized apparatuses in the art, there is a type comprising a guitar shaped playing device to produce performance information which presents really guitar-like features in performance tones. A further type of performance information producing apparatus for similar purposes is the one that stores accompaniment patterns consisting of sequences of note pitches and note generation timings of the normalized chords and shifts the respective note pitches in the accompaniment pattern in accordance with each designated chord to produce the intended performance information involving the designated chords.

The guitar shaped playing device, however, can be played or manipulated by only those who can play the guitar actually. The performance information producing apparatus employing the accompaniment patterns of chords can hardly realize the really guitar-like voicing in terms of chord notes structure, and that it can be hardly expected that really guitar-like performance information is produced.

SUMMARY OF THE INVENTION

It is, therefore, a primary object of the present invention to provide a novel type of music performance information composing apparatus and method, and a machine readable medium containing a program therefor with which even a person who cannot play the actual guitar or the like stringed instrument can compose or produce performance information that includes voicings peculiar to the guitar-like stringed instrument and represents musical performance on the actual stringed musical instrument such as the guitar, by simply manipulating the devices on the apparatus.

According to the present invention, the object is accomplished by providing a musical performance information composing apparatus for composing performance information which represents a musical performance on a stringed instrument having a plurality of strings, each string being capable of generating a tone having a pitch which is selectively assigned to each string from among plural pitches available on each string, the apparatus comprising: a chord designating device which designates a chord; a tone pitch determining device which determines pitches of tones to be respectively assigned to the plurality of strings such that the tones of the determined pitches constitute the designated chord; a string and timing designating device which designates strings to be assigned for tone generation from among the plurality of strings and designates a timing for each of the designated strings at which timing the assigned tone is to be generated; and a tone data generating device which generates tone data of the tones having the determined pitches, the data of each tone representing the tone generation on the string and at the timing as designated by the string and timing designating device.

According to an aspect of the present invention of the above-mentioned structure, the string and timing designating device comprises a plurality of manipulating elements, each of which is individually assigned to each of the plurality of strings, and preferably further comprises a plurality of manipulating elements, each of which is assigned to a manner of playing plural strings in combination, and still preferably further comprises a storage device which stores at least one template defining a generation timing of each tone assigned to each of the strings played in a cutting fashion or in an arpeggio fashion.

According to the present invention, the object is further accomplished by providing a method for composing performance information which represents a musical performance on a stringed instrument having a plurality of strings, each string being capable of generating a tone having a pitch which is selectively assigned to each string from among plural pitches available on each string, the method comprising the steps of: designating a chord; determining pitches of tones to be respectively assigned to the plurality of strings such that the tones of the determined pitches constitute the designated chord; designating strings to be assigned for tone generation from among the plurality of strings, and designating a timing for each of the designated strings at which timing the assigned tone is to be generated; and generating tone data of the tones having the determined pitches, the data of each tone representing the tone generation on the designated string and at the designated timing.

According to the present invention, the object is still further accomplished by providing a machine readable medium for use in an apparatus for composing performance information which represents a musical performance on a stringed instrument having a plurality of strings, each string being capable of generating a tone having a pitch which is selectively assigned to each string from among plural pitches available on each string, the apparatus being of a data processing type comprising a computer, the medium containing program instructions executable by the computer for executing: a process of designating a chord; a process of determining pitches of tones to be respectively assigned to the plurality of strings such that the tones of the determined pitches constitute the designated chord; a process of designating strings to be assigned for tone generation from among the plurality of strings, and designating a timing for each of the designated strings at which timing the assigned tone is to be generated; and a process of generating tone data of the tones having the determined pitches, the data of each tone representing the tone generation on the string and at the timing as designated by the process of designating strings and a timing for each string.

According to the present invention, therefore, even if the user cannot play the actual guitar or the like stringed instrument, the user can realize realistic guitar-like performance with unique guitar voicing, by simply composing performance data which represents chords, strings and timings of tone generation and having the composed data played on the data controlled music performance apparatus.

As will be apparent from the description herein later, some of the structural element devices of the present invention are configured by a computer system performing the assigned functions according to the associated programs. They may alternatively be hardware structured discrete devices.

Further as will be understood from the description herein about the apparatus for composing stringed musical instrument performance information, a sequence of the steps, each performing the operational function of each of the structural elements of the performance information composing apparatus will constitute a method for composing stringed musical instrument performance information according to the spirit of the present invention.

Still further as will be understood from the description herein about the apparatus and the method for composing stringed musical instrument performance information, a machine readable medium containing a program instructions executable by a computer system for executing a sequence of the processes each performing the operational function of each of the structural elements of the performance information composing apparatus or performing each of the steps constituting the performance information composing method will reside within the spirit of the present invention.

These and other advantages of features in the present invention shall become apparent to the reader in view of the accompanying drawings and detailed description.

BRIEF DESCRIPTION OF THE DRAWINGS

For a better understanding of the present invention, and to show how the same may be practiced and will work, reference will now be made, by way of example, to the accompanying drawings, in which:

FIG. 12 is a flow chart showing the detour portion of the process routine to be combined with FIG. 11 for composing performance information under the real-time recording mode in the embodiment of the present invention.

The drawings are only for purposes of illustrating a preferred embodiment and processes of the present invention and are not to be construed as limiting the invention. Various modifications can be made without departing from the spirit of the invention.

DESCRIPTION OF THE PREFERRED EMBODIMENTS

Hardware Structure

Figure 1:
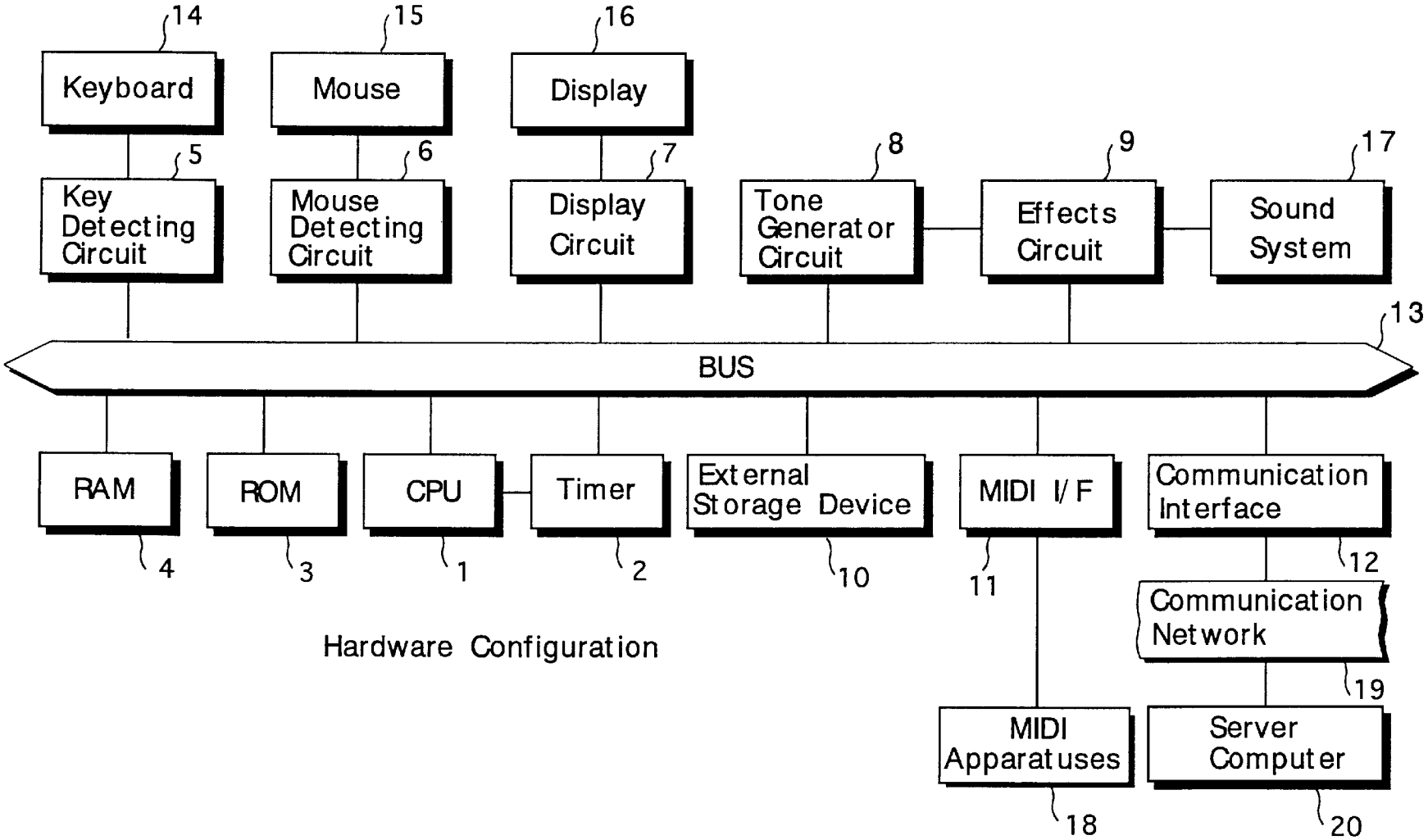
FIG. 1 is a block diagram showing a hardware structure of an embodiment of a performance information composing apparatus according to the present invention.

Illustrated in FIG. 1 of the drawings is a general block diagram of the hardware structure of a stringed musical instrument performance information composing apparatus according to an embodiment of the present invention. The performance information composing apparatus comprises a central processing unit (CPU) 1, a timer 2, a read only memory (RAM) 3, a random access memory (RAM) 4, a key detecting circuit 5, a mouse detecting circuit 6, a display circuit 7, a tone generator circuit 8, an effects circuit 9, an external storage device 10, a MIDI (musical instrument digital interface) interface 11, and a communication interface 12, all of which are connected with each other via a bus 13. To the key detecting circuit 5 is connected a keyboard 14 as an input device, to the mouse detecting circuit a mouse 15 as another input device, to the display circuit 7 a display device 16, and to the effects circuit 9 a sound system so that the tones from the tone generator circuit 8 based on the performance data are played back in sound. Being configured as a system, the apparatus of the present invention may be connected to other MIDI apparatuses 18 such as a keyboard device and an external tone generator device via the MIDI interface 11 such that various musical tone data can be transmitted to or received from those external musical tone processing devices in case of necessity. The MIDI interface 11 may not necessarily be of an exclusively designed one, but may be constructed by using a general-purpose interface such as an RS-232C, a USB (universal serial bus) and an IEEE1394. The communication interface 12 is for tie connection with a server computer 20 via a communication network 19 such as a telephone line for data communication.

The system of the present invention may be configured by a personal computer with application software functioning similarly to a personal computer system with a built-in tone source devices or a system including a sequencer device having a hard disk drive, a tone source device and a display device. In such a system, the application software may be stored in the external storage device 10 equipped with a storage medium such as a magnetic disk, an optical disk and a semiconductor memory.

The system of the present invention may be practiced in the form of an electronic musical instrument including a musical keyboard, pedals, a control panel with associated control switches, tone generators, an automatic performance device, etc. The form of the electronic musical instrument may not be limited to a keyboard type, but may also be a stringed instrument type, a percussion instrument type, or else. The tone generator device and the automatic performance device may not necessarily be built in an electronic musical instrument console, but may be separate individual devices as long as they are connected via the MIDI interface, or the communication interface and the communication network, or other communication means. The system of the present invention can be used for composing accompaniment music data for use in the karaoke device.

Referring to FIG. 1, the CPU 1 controls the entire system in data processing and is connected to the timer 2, which generates a clock signal to be used for an interrupt clock, a tempo clock, and other timing signals. The CPU 1 executes the programs to perform various process steps for composing the performance information according to the invention. The ROM 3 stores predetermined control programs for controlling the system and a basic table of constituent notes BT. The control programs include various processing programs relating to the production of the performance information. The RAM 4 provides work areas for various processing of the invention, including storage areas for necessary performance data and parameters. The work areas to be provided will be an area for a user table of constituent notes UT, an area for a chord track ChT and areas for note tracks NtTn, which are collectively for an automatic performance data PD.

The key detecting circuit 5 and the mouse detecting circuit 6 detect the manipulations of the keyboard 14 and the mouse 15, respectively, and supply the detection data to the CPU 1 via the bus 13. The display circuit 7 is supplied with display information via the bus 13 and causes the display device 16 to exhibit on the screen the pictures necessary for the process of composing performance information. The keyboard 14 and the mouse 15 are input devices of a manipulation panel type and a coordinate pointing type, respectively, for the system. The keyboard 14 has manipulating buttons such as alphabetic keys and numeric keys, and may additionally have some specific switches necessary for the operation of the performance information composing apparatus. Thus, the user can conduct inputting operations such as various designations, selections and data entries.

Tone Generation

The tone generator circuit 8 and the effects circuit 9 produce tone signals based on the data of the composed performance information, and supply to the sound system 17 for emitting audible sounds as a checking playback. The tone generator circuit 8, the effects circuit 9 and the sound system 17 may serve to play back the performance data in the system and the performance data from the MIDI apparatuses 18.

The tone generator 8 includes a plurality of tone generation channels for generating plural tones simultaneously for a polyphonic performance. The types of the tone generation may be arbitrarily employed from among the waveform memory type, the FM synthesis type, the physical model type, the harmonics synthesis type, the formant synthesis type, the analog synthesizer type of a "VCO+VCF+VCA" structure, the analog simulation type, and any other types. Further, the tone generator 8 may not be limited to a hardware device exclusively provided for tone generation, but may be a combination of a DSP (digital signal processor) and a microprogram, or a combination of a CPU and a software program. The plurality of tone generating channels may be constructed by individual separate circuits in the number corresponding to the number of channels, or may be constructed by a single circuit operated in a time division multiplexed fashion. The effects circuit 9 is to impart to the tone signals generated by the tone generator circuit 8 various effects such as a chorus effect and a reverberation effect.

Performance Data

The performance information composed by the present invention can be in any arbitrary style among various styles as the automatic performance data to be used for an automatic performance. The data format may be the "event+relative time" style in which the time point of each event occurrence is expressed in relative times counted from each preceding event, or may be the "event+absolute time" style in which the time points of the events are expressed in absolute times counted from the top of the music or each measure, or may be the "pitch (rest)+duration" style in which the music progression is expressed by note pitches, note durations, rests and rest durations, or may be the "event map" style in which memory addresses are previously assigned for all the time points of the minimum resolution in the musical progression and each event content is stored at the assigned address for that time point. Any other arbitrary style may also be employed.

The manner of varying the tempo of the automatic performance may also be variously employed. For example, the period of the tempo clock may be varied, or the values of timing data may be modified with the period of the tempo clock unchanged, or the count value per processing of the timing data may be altered.

Where there are automatic performance data for a plurality of channels, the data for plural channels may be stored in an intermingled manner, or may be stored in a separate storage track for every channel.

In storing the performance data, the data may be stored at contiguous sites in the memory according to the lapse of time, or may be stored at skippingly scattered sites in the memory with an administration as contiguous data pieces of a given sequence. In other words, the performance data has only to be handled as timewise successive data in operation, and does not have to be successively located on the memory.

Storage Medium

As the external storage device 10, one or plural types of storage device can be used according to necessity as selected from among a hard disk drive (HDD), a floppy disk drive (FDD), a CD-ROM drive, a magneto-optical (MO) disk drive and a digital versatile disk (DVD) drive. The storage medium in such a storage device stores music piece (or tune) data including various accompaniment data recorded, for example, in the MIDI format.

As mentioned above, the control programs stored in the ROM 3 include various processing programs for composing performance information according to the present invention, but the processing programs may be stored in a magnetic disk, an optical disk, a magneto-optical disk, a semiconductor memory, etc. as the application software, and may be supplied from the external storage device 10 to the apparatus system. Or alternatively, the application programs may be obtained through the communication network 19 as will be described herein later.

Storing Programs in HDD or CD-ROM

As is well known in the field, the HDD is a mass storage device for storing various control programs and various data, and is equipped with a hard disk (HD) as the storage medium. For example, in case the control programs are not stored in the ROM 3, the programs may be stored in the hard disk of the HDD and may be transferred to the RAM 4 so that the CPU 1 should execute the programs in the similar way as the case where the programs are stored in the ROM 3. Such a fashion will be advantageous in that the addition and the up-grading of the control programs can be easily made.

The CD-ROM drive, on the other hand, is a read-out device for a portable mass storage medium CD-ROM storing various control programs and various data. Thus, the control programs and the data may be stored in a CD-ROM, read out by the CD-ROM drive, and transferred into a hard disk in the HDD so that the CPU 1 should operate in the similar way as described above. This will facilitate the new installation or the up-grading of the control programs.

Other than the CD-ROM, there are various kinds of detachable and portable storage media like the floppy disk, the magneto-optical disk and the digital versatile disk, and therefore any of the FD drive, the MO disk drive, the DVD device, etc. may be used, alone or in combination according to necessity, in addition to the HDD device. And in case the medium is of a writable type as a floppy disk, the data obtained in the system during processing can be taken out separately.

Down Loading Programs Through Network

The communication interface 12 serves to down load programs and data from a server computer 20 via the communication network 19, in case the control programs and the necessary data are not stored in the ROM 3 or the connected external storage device 10. In such a case, the system of FIG. 1 is a client in the network, and transmits via the communication interface 12 and the communication network 19 to the server computer a request command of down loading the control programs and the data from the server computer 20. Upon receipt of the request, the server computer 20 delivers the requested program and data over the communication network 19. The delivered programs and data are received by the system via the communication interface 12, and stored in the hard disk of the HDD device, which completes the down loading procedure.

Outline of Function Blocks

Figures 2, 3A, 3B:
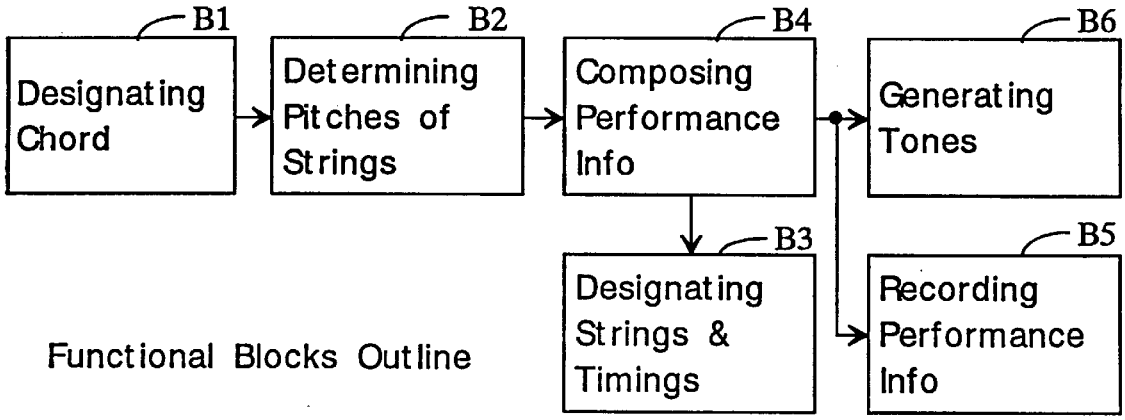
FIG. 2 is a chart showing an outline of functional blocks operated in the process of composing the performance information according to the present invention.
FIG. 3*a* is a chart showing an example of the contents of a basic table of constituent notes provided in the embodiment of the present invention.
FIG. 3*b* is a chart showing an example of the contents of a user table of constituent notes provided in the embodiment of the present invention.

In FIG. 2 is shown a block diagram representing the outline of the functions performed by structural devices of an embodiment of the stringed musical instrument performance information composing apparatus according to the present invention. In a block B1, a chord CH to be generated is designated by instructing the root note (C, C#, . . . ) and the type (maj, min, . . . ) of the intended chord by manipulating the mouse 15 or by playing back a chord track ChT of the sequencer stored in the automatic performance data storage area of the RAM 4. In a block B2, the pitches Nn of the tones to be generated on the respective strings SRn (n=1, 2, . . . , 6: string number) of a guitar are determined according to the chord CH designated in the block B1. In a block B3, the strings SRn and the timings Tn for the respective tones to be generated are designated by manipulating the keys SpK to which the strings and the playing manners are assigned in the keyboard 14 or by reading out the template TM stored in the RAM 4.

In a block B4, the tone pitches Nn determined in the block B2 are assigned to the strings SRn designated in the block B3, respectively, and the tone data NDn are generated respectively having the tone pitches Nn on the corresponding to the designated strings SRn. The alignment of the tone data NDn composes the performance information of the present invention. The composed performance information containing the tone data NDn is recorded on the storage device at a block B5 and also is converted into audible sounds (as played music) at a block B6. The recording of the composed performance information at the block B5 may be conducted in a music position designating mode, or a step-by-step recording mode, or a real-time recording mode, or else (as long as applicable). The audible sound generation at the block B6 may be controlled by clicking the play button LB on the screen of the display device 16. Or under the real-time recording mode, audible sounds are generated at the block B6 responsive to the manipulations of the keys SpK on the keyboard 14 to which are assigned the strings and the playing manners or to the manipulations of the keys TmK on the keyboard 14 to which are assigned the templates.

Tables of Constituent Notes

In FIG. 3*a* is shown an example of the contents of a basic table of constituent notes BT stored in the allotted area in the ROM 3. In this example, chords are classified into two categories (herein termed as "chord variations CV") from a structural point of view, i.e. low position chords Lo and high position chords Hi. Each chord variation CV includes all available chord names CH each identified by the root note and the type. For each of the chord names CH, there are provided a set of chord constituent notes (chord tones) CT in terms of string numbers SRn, note names Nn and fret numbers FRn. The data base of chord tones TC lists the note name Nn and the fret number FRn for each of the six strings SR1 through SR6.

The low chords Lo are chords played around the lower fret position on the stringed instrument, for example using the 0th–3rd frets and often using open strings. The high chords Hi are chords played using higher fret positions without using an open string. For the low chord category Lo, therefore, the chord tone data base TC indicates the relationship among the note name Nn, the string number SRn and the fret number FRn for the tone generation in the lower fret position area. And for the high chord category Hi, the chord tone data base TC indicates the relationship among the note name Nn, the string number SRn and the fret number FRn for the tone generation in the higher fret position area.

More specifically, for example, the low chord category include a chord CH of Cmaj (C major), Cmin (C minor), . . . , C#maj (C# major), . . . , wherein the chord constituent note data set TC of the Cmaj chord includes, for the respective strings SRn (1st, 2nd, 3rd, 4th, 5th and 6th strings), the note names Nn (E4, C4, G3, E3, C3, and E2 notes) and the fret positions FRn (0th, 1st, 0th, 2nd, 3rd and 0th frets), respectively. Here, the 0th fret means the open string, and the 1st fret means to press the string at the 1st fret position, and so forth.

In FIG. 3*b* is shown an example of the contents of a user table of constituent notes UT stored in the allotted area in the RAM 4. The user table is a table established by the user according to the user's preference to include user specific chord constituent note data sets TC for each intended chord name CH indicating preferred note and fret assignments for the respective strings (example of contents not shown). The user table is stored in the RAM 4 under the chord variation index CV of "Usr". The constituent note tables BT and UT are used in determining the tones Nn to be assigned to the respective strings SRn based on the chord constituent note data TC for the designated chord CH and in displaying the fret positions FRn to depress for the respective strings SRn in the guitar fretboard simulating box TcA on the screen of the display device 16, according to the selection of the chord variation CV (Lo, Hi or Usr) by the user.

Figure 4:
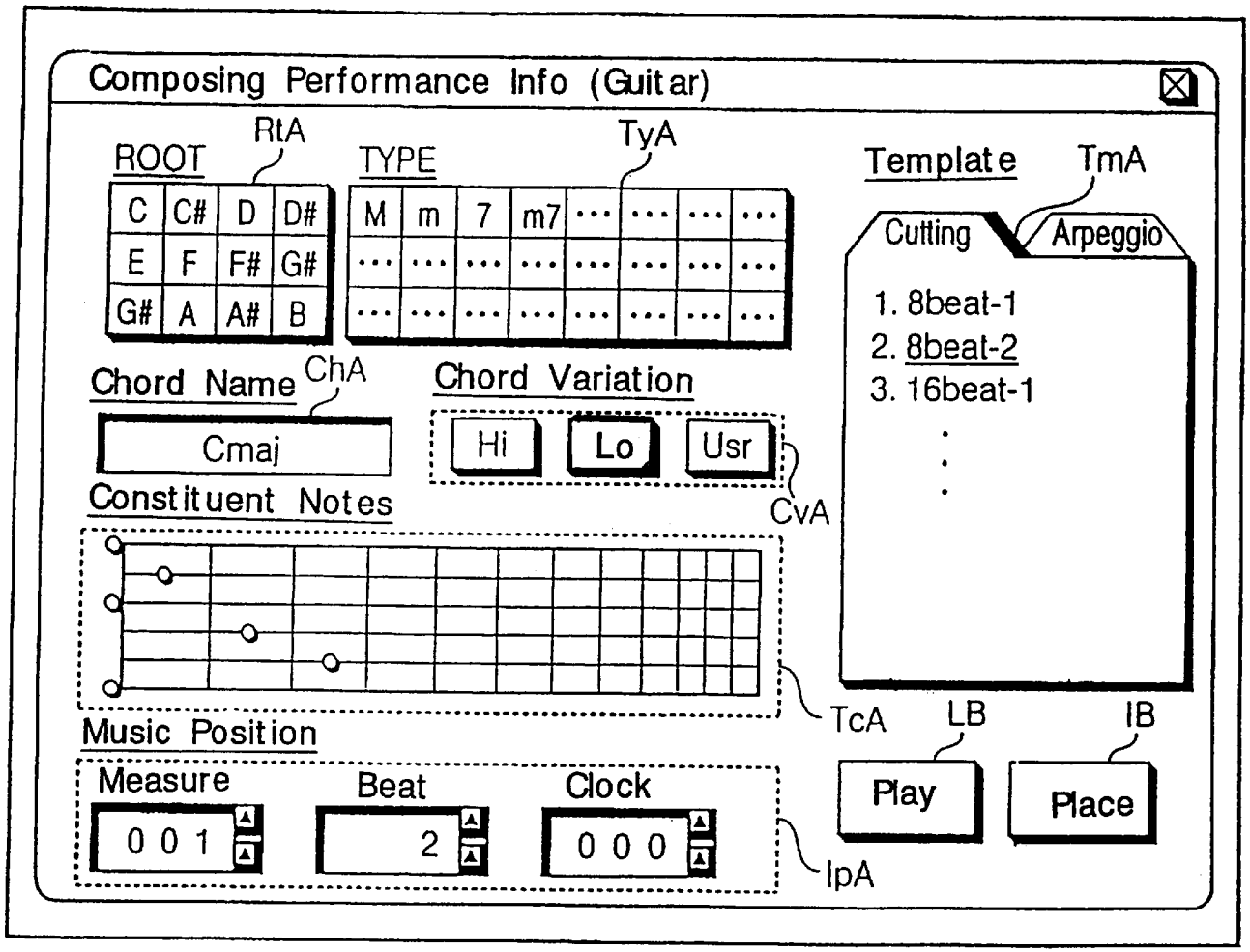
FIG. 4 is a chart showing an example of the screen format exhibited on the display device in the present invention.

In FIG. 4 is shown an example of the screen format exhibited on the display device 16 during the processing of composing performance information according to the present invention. In this example, the left two-thirds area of the frame includes a chord root note designating box RtA and a chord type designating box TyA in the upper region; chord name indicating box ChA, a chord variation designating site CvA and a chord constituent note exhibiting box TcA in the middle region; and music position designating site IpA for designating a measure, a beat and a clock count in numerical values in the lower region. The right one-third area of the frame includes a chord template designating site TmA across the upper and the middle regions, and a play button LB and place button IB in the lower region.

The chord name indicating box ChA exhibits a chord name CH defined by the root note RT and the chord type TY as designated at the root note designating box RtA and the chord type designating box TyA, or a chord name CH which is selectively read out from the chord track ChT established in the automatic performance data PD in the RAM 4. The chord constituent note (chord tone) exhibiting box TcA fixedly shows six horizontal lines representing six strings and a plurality of vertical lines representing the respective frets of the guitar. On these horizontal and vertical lines are variably shown small circles representing the depressing positions of the strings and frets according to the fret number FRn of the corresponding string number SRn in the chord constituent note (chord tone) data TC which has been retrieved referring to the tables of constituent notes BT and UT of FIG. 3.

Function Assignment on Keyboard

Figure 5:
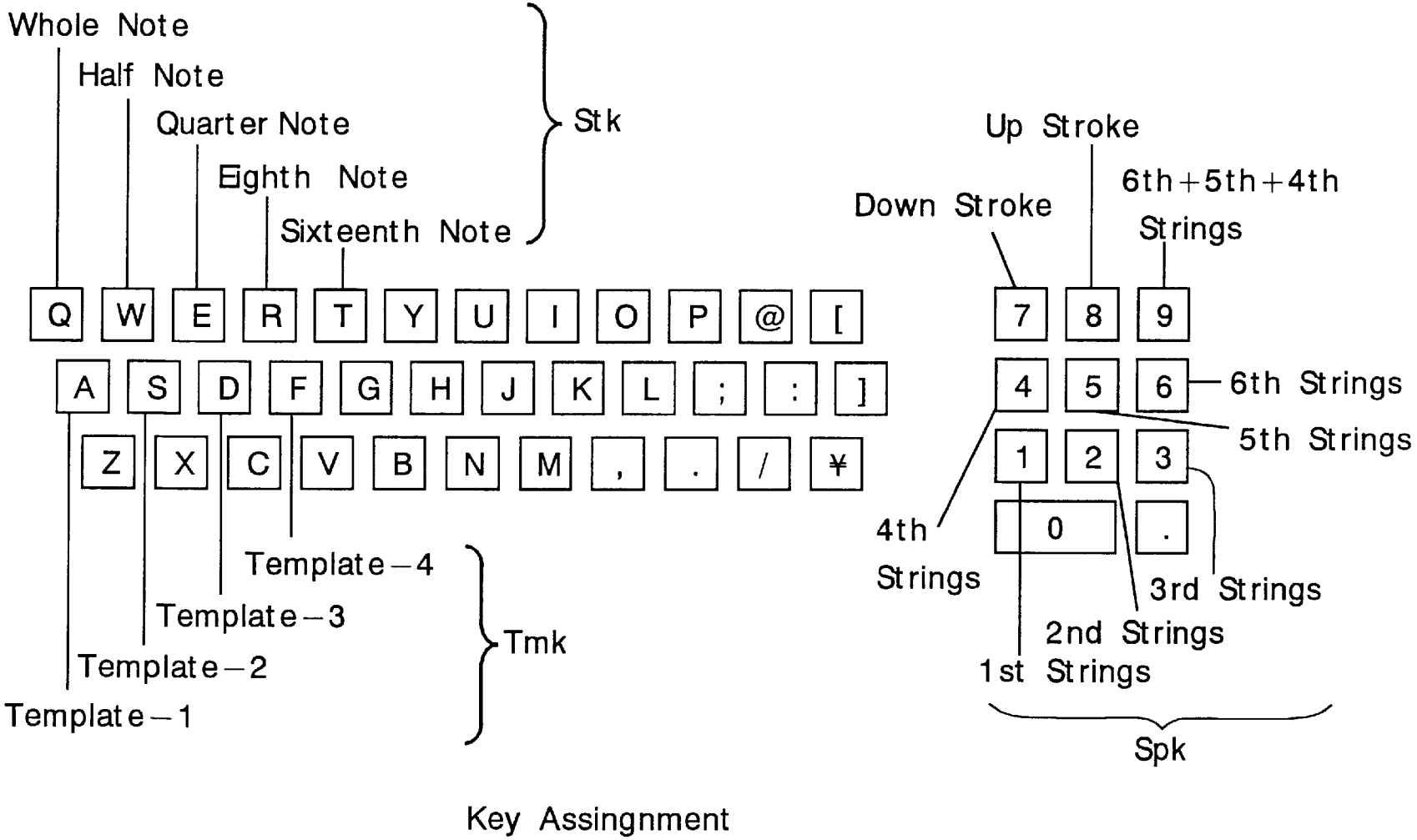
FIG. 5 is a chart showing an example of the keyboard assignment for various designations manipulated on the embodiment apparatus of the present invention.

FIG. 5 shows an example of assignment of various designating functions to manipulating keys on the keyboard 14. In this example, several alphabetic keys in the left area are assigned to the functions of step time designating keys StK and of template designating keys TmK, and numerical keys in the right area are assigned to the functions of string and playing manner designating keys SpK.

The step time designating keys StK are the keys for designating "step times" ST which represent the time lengths from the generation of one tone to the generation of the next tone in terms of note durations, and are mainly used in the operation of the step-by-step recording mode. In the example shown in FIG. 5, the alphabetic character keys "Q", "W", "E", "R" and "T" are assigned to the whole note, the half note, the quarter note, the eighth note and the sixteenth note. The template designating keys Tmk are the keys for designating "templates" to be used in the operation of the real-time recording mode. The alphabetic character keys "A", "S", "D" and "F" are assigned to four templates i (i=1, 2, 3 and 4).

Figure 6A:
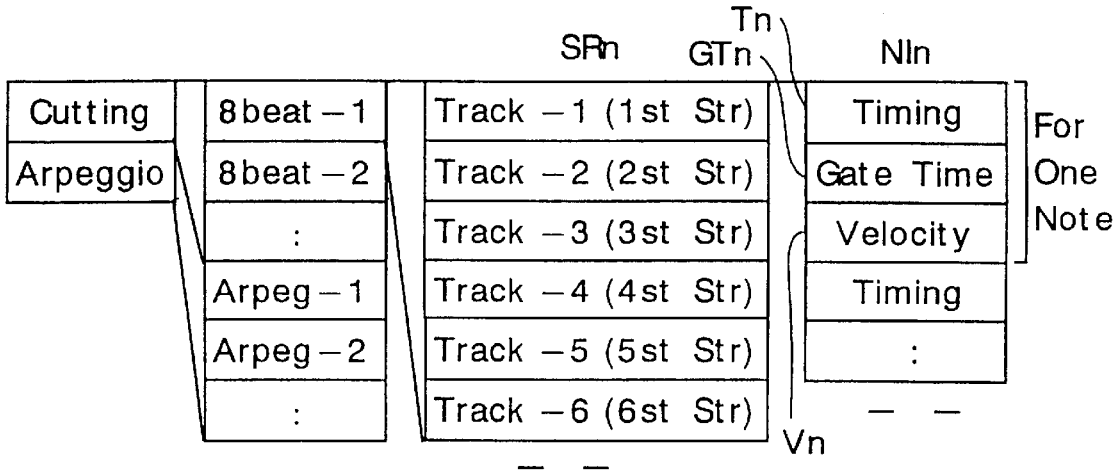
FIG. 6*a* is a chart showing an example of the template structure used in the embodiment of the present invention.

The template is a performance pattern that defines which string generates which tone at which timing, and includes data, for example, in the format shown in FIGS. 6*a,* 6*b* and 6*c*. The template i which is designated by the template designating key TmK identifies which specific performance pattern may be previously set in the apparatus or may be arbitrarily set by the user. By storing a plurality of templates i respectively having predetermined performance patterns in the predetermined area of the ROM 3 or the RAM 4 corresponding to the respective template designating keys TmK, the user can access the intended template i by manipulating the assigned key.

The string and playing manner designating key SpK are the keys for designating tone generation on the respective guitar strings individually in terms of string numbers SRn or collectively for certain plural strings in terms of playing manners, or strokes in this example specifically. In the shown example of the assignment, the numeric keys "1" through "6" are respectively assigned to the first through sixth strings SR1 through SR6 individually. The numeric key "7" is assigned to the "down stroke" DS which is a manner of playing the guitar, i.e. a manner of generating tones on the guitar in which the strings are plucked successively from the sixth string (lowest E2 string) SR6 to the 1st string (highest E4 string) SR 1 with slight time lags, and the numeric key "8" is assigned to the "up stroke" US which is a manner of playing the guitar in which the strings are plucked successively from the 1st string (highest E4 string) SR 1 to the sixth string (lowest E2 string) SR6 with slight time lags. "Down" and "up" are so named with reference to the direction of gravity under the normal posture of playing the guitar. The numeric key "9" is assigned to "6th+5th+4th strings" which is a manner of playing the guitar in which the 6th, 5th and 4th strings SR6, SR5 and SR4 are plucked simultaneously, namely the data for generating tones are produced in the electronic apparatus as if tones are sounded on the respective strings on the actual guitar.

Template Structure

FIGS. 6*a,* 6*b* and 6*c* show examples of the structures of the templates TM used in the processing of generating performance information according to the present invention. These templates are stored in the predetermined areas of the ROM 3 or the RAM 4. The template consists of performance pattern data of the strings SRn aligned in time sequence in the amount of one to several measures. As shown in FIG. 6*a,* the templates are provided for the respective performance styles of "8 beat-1", "8 beat-2", etc. under the cutting play category and the respective performance styles of "Arpeg-1", "Arpeg-2", etc. under the arpeggio play category. Each template, therefore, includes data representing the details of notes NIn with respect to the respective ones of the strings SRn for one performance style nominated by the template.

In more detail, the performance pattern data of each string SRn includes note sounding data sets NIn representing the details of plural successive notes, each data set NIn being a structural unit of the performance pattern and consisting of timing data Tn which represents the sounding timing of the string, gate time data GTn which represents the sounding duration (length of time) of the string, and velocity data Vn which represents the sounding volume of the string for one note. Therefore, one template TM is formed by successively aligning the note sounding data sets NIn, each consisting of the data Tn, GTn and Vn, on each of the string tracks #1 through #6 corresponding to the strings SR1 through SR6 in the amount of one to several measures.

Figure 6B:
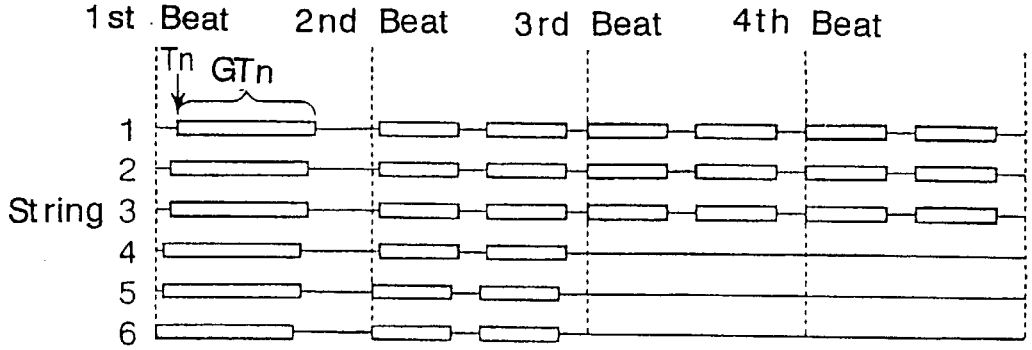
FIG. 6*b* is a musical time chart showing an example of the contents of a cutting template used in the embodiment of the present invention.
Figure 6C:
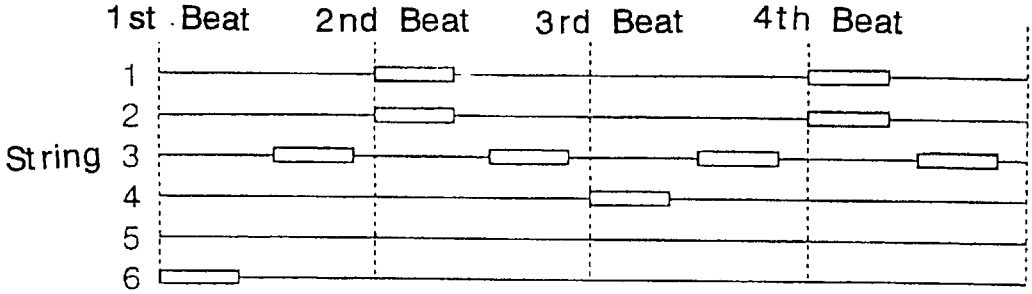
FIG. 6*c* is a musical time chart showing an example of the contents of an arpeggio template used in the embodiment of the present invention.

FIG. 6*b* illustrates an example of the cutting template in a certain performance style, in which note sounding times of the respective strings are visually depicted taking time lapse in the abscissa and placing 1st through 6th strings vertically. The hollow rectangles represent the sounding states of the strings, the left end of each rectangle indicates the start of sounding, i.e. the timing Tn, and the horizontal length of each rectangle indicates the sounding duration, i.e. the gate time GTn. The vertical dotted lines indicates the positions of the beats (beat heads) in the measure. FIG. 6*c* illustrates an example of the arpeggio template in a certain performance style in the same way as FIG. 6*b*. The rectangles should be interpreted similarly.

Automatic Performance Data

Figure 7:
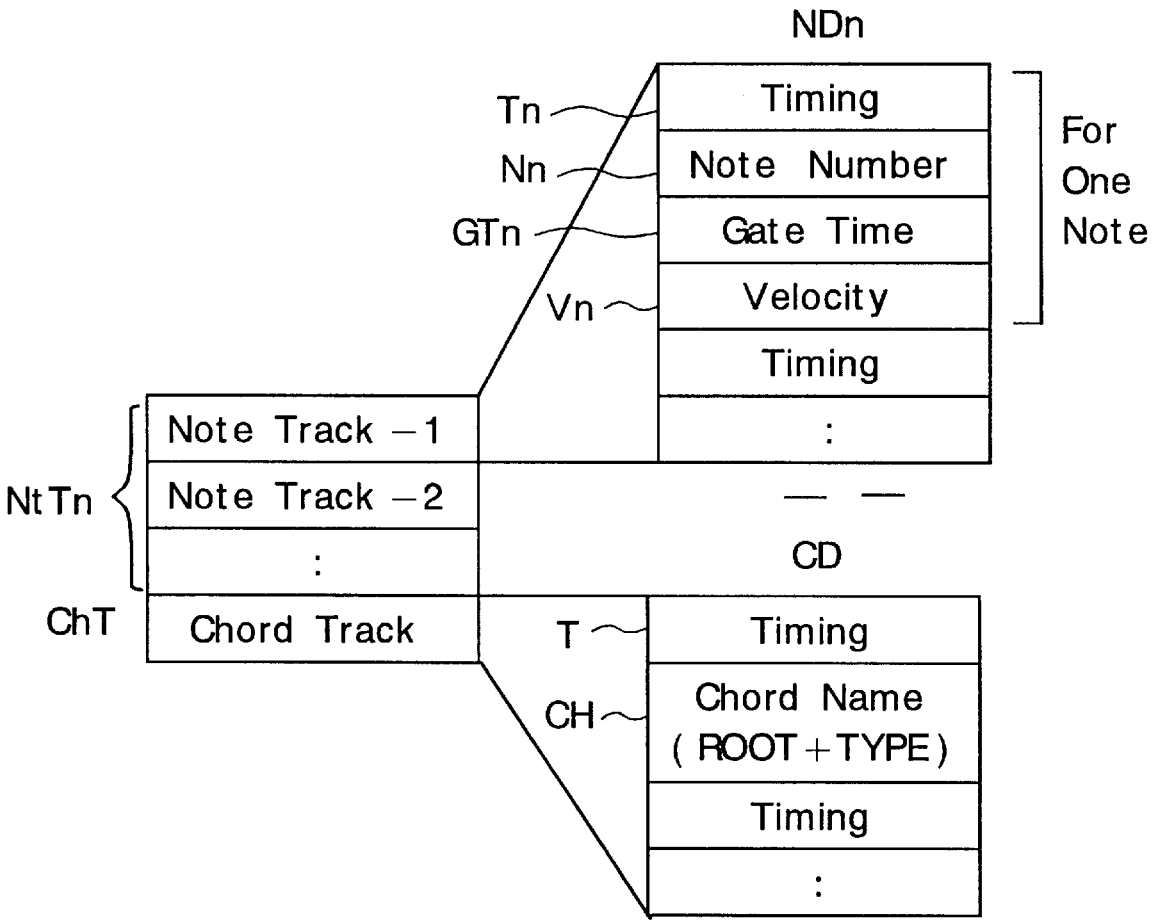
FIG. 7 is a chart showing an example of the data structure of the performance information as provided in the embodiment of the present invention.

FIG. 7 shows an example of the data structure of the automatic performance information PD stored in the automatic performance data storage area in the RAM 4 and used in connection with the processing of composing performance information in the embodiment of the present invention. The automatic performance information PD includes a plurality of note tracks NtTn and a chord track ChT prepared and secured for the length of a piece of music. The automatic performance information PD may also include a rhythm track (not shown) on which a rhythm progression by percussion instrument tones is recorded defining the rhythmic progression of a piece of music. The automatic performance information PD may further include a melody track (not shown) on which a melody is recorded, to which the composed performance information of the present invention is applied as an accompaniment. In the embodiment, each of the note tracks NtTn (n=1, 2, . . . ) is provided in correspondence to each of the strings SRn (n=1, 2, . . . ). Each note track NtTn is a successive alignment of note data sets NDn, each data set consisting of four data pieces of sounding timing Tn, note number Nn, gate time (sounding time length) GTn and velocity (sounding tone volume) Vn. The timing Tn, the gate time GTn and the velocity Vn in the note data NDn can be obtained from the above described template TM according to the processing of composing performance information.

The chord track ChT contains a successive alignment of chord data sets CD, each data set consisting of two data pieces of timing data T and chord name data CH, thereby constituting a chord sequence (progression) for a piece of music. The chord track may be rewritable so that the designated chords in the course of practicing the present invention can be recorded on the chord track. Or another chord track may be provided for such recording. In composing the stringed instrument performance information according to the present invention, the chord name data CH can be designated by the root note designating box RtA and the chord type designating box TyA in the display screen of FIG. 4. On the other hand, the chord track ChT may be played back as a chord sequencer and the thus read out chord data CD may be used in designating the chord names CH in the constituent note table BT or UT.

Note Data

According to the present invention, the note data NDn are generated by using the template TM or by using the string and playing manner designating keys SpK, which will be described in more detail hereunder.

(1) Using Template TM

In order to generate the note data NDn by using the template TM as will be explained herein later with respect to steps SP17 (FIG. 9), SS17 (FIG. 10) and SN10 (FIG. 13), the timing Tn, the gate time GTn and the velocity Vn of the note data set NDn in the template TM (FIG. 6), if existing, are employed as the note data, the gate time data and the velocity data of the composing note data NDn. As to the note number Nn, the note names Nn of the respective strings SRn are retrieved from the chord tone data set TC (FIG. 3) according to the designated chord variation CV ("Lo", "Hi" or "Usr") and the designated chord name CH, the retrieved note name Nn is then determined as the note name Nn of the string SRn which corresponds to the string track SRn (FIG. 6*a*) in which the note sounding data set NIn is stored, and is employed as the note number Nn of the note data set NDn (FIG. 7) for the performance information being composed.

Depending on the chord name CH and the chord variation CV, there may be a string or strings to be muted. In case the template TM includes a note sounding data set NIn for the string SRn which is to be muted, either of the following handling will be taken:

a) Putting priority on the fact that the string is to be muted, no note data set NDn is generated for that string.

b) Putting priority on the fact that the template TM includes note sounding data sets NIn for the string, a note data set NDn is generated for that string using the note name of another string (for example, a string which is closest to the string to be muted, the highest or the lowest string among the strings not to be muted, or a randomly determined string, or else).

Under the processing by using a template TM, when the note data sets NDn have been generated in the amount of the length of the template, the processing is adjourned and waits the next composition command. The length in time of the note data sets NDn to be composed may be designated by the number of measures to be composed, or the number of repetitions of the data to be composed, or else.

(2) Using String and Stroke Keys SpK

In order to generate the note data NDn by using the string and stroke keys as will be explained herein later with respect to steps SP19 (FIG. 9), SS20 (FIG. 10) and SN4 (FIG. 13), the music position to place the note data set NDn is determined to be the music position as designated by the music position designating site IpA (FIG. 4) or by the step time designating key StK (FIG. 5). However, in case the down stroke DS (numeric key "7") or up stroke US (numeric key "8") is designated, the music position of the first tone among plural stroke tones is such designated position, and the positions of the rest of the plural stroke tones are determined with successively increasing slight time lags.

As to the note number Nn, the note names Nn of the respective strings SRn are retrieved from the chord tone data set TC (FIG. 3) according to the designated chord name CH and the designated chord variation CV ("Lo", "Hi" or "Usr"), the retrieved note name Nn is then determined as the note name Nn of the string SRn which is assigned to the depressed key among the string and stroke designating keys SpK (numeric key "1" through "9", and is employed as the note number Nn of the note data set NDn (FIG. 7) for the performance information being composed.

The gate time GTn may be determined based on the step time ST which is designated by the step time designating key StK (FIG. 5), for example, to be 80% of the length of the step time ST, the velocity Vn may be a predetermined fixed value, and the mute of a string or strings may be handled in a similar manner as described above in connection with the case of using the template TM.

Processing in Music Position Designating Mode

The music position designating mode is a mode in which performance information is composed by generating note data sets NDn for the respective strings SRn and placing the generated data sets at intended position of the music progression. FIGS. 8*a* through 13 shows, as examples, flow charts of the processing for composing performance information in various modes according to the present invention. The music position designating mode is operated according to the flow charts shown in FIGS. 8*a,* 8*b* and 9, where FIGS. 8*a* and 8*b* in combination show the first half of the process routine of this mode, when read in conjunction with the step legends SPn (n representing numerals), and FIG. 9 show the second half of the process routine of this mode. Upon instruction by the user to start the music position designating mode by means of an instruction switch (not shown), the process flow of "composing performance information under the music position designating mode" is initiated. This processing mode is applied in composing performance information by placing the generated note data on any intended positions in the music progression, in which the music positions are precisely designated by handling the music position designating site IpA on the display screen shown in FIG. 4, irrespective of the actual time necessary for the user to manipulate the apparatus.

(1) Initial Setting

Figure 8A:
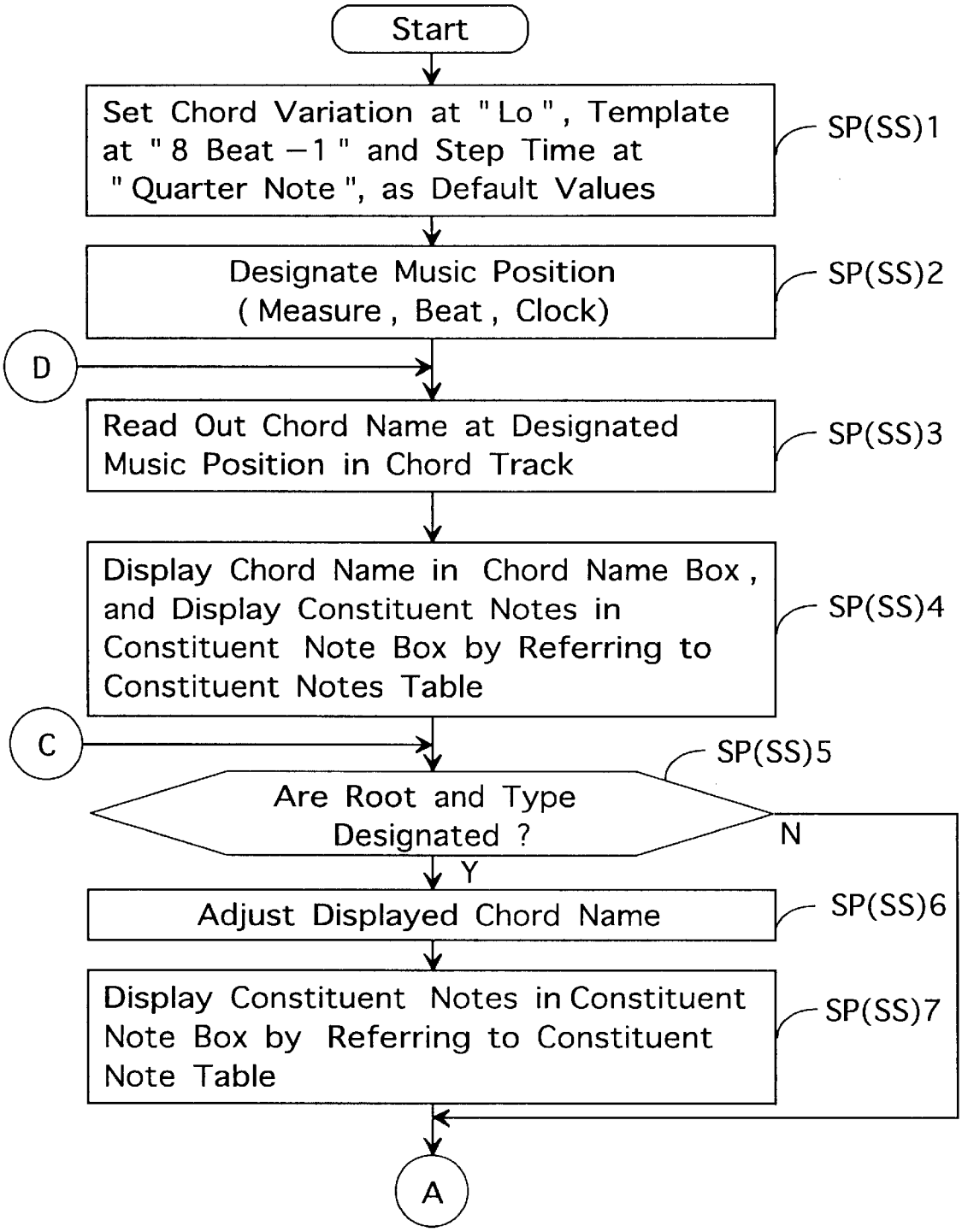
FIGS. 8*a* and 8*b*, in combination, are a flow chart showing in common the first half of the process routine for composing performance information under the music position designating mode and the first half of the process routine for composing performance information under the step-by-step recording mode in the embodiment of the present invention.
Figure 9:
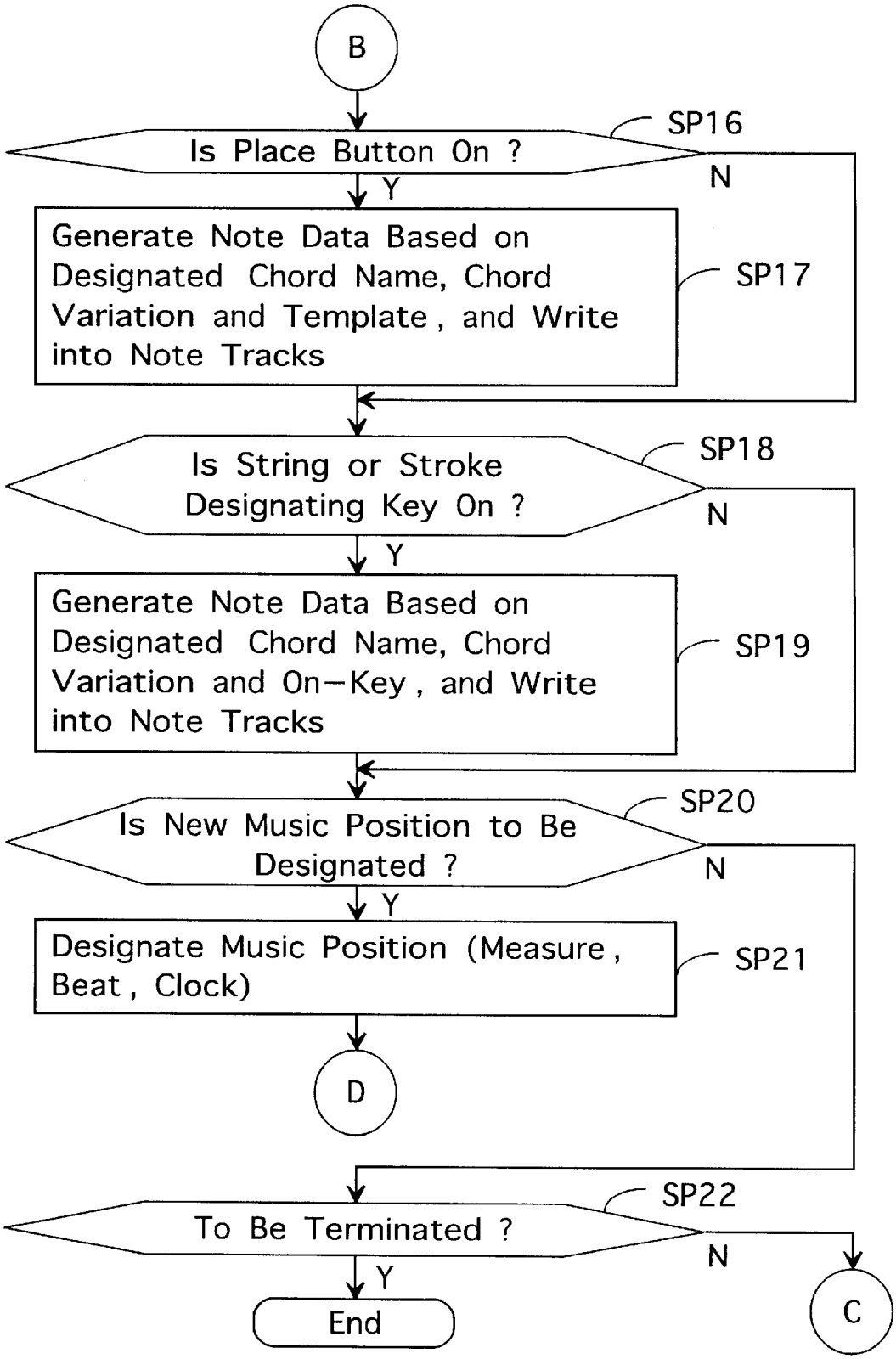
FIG. 9 is a flow chart showing the second half of the process routine for composing performance information under the music position designating mode in the embodiment of the present invention.

As the processing of the music position designating mode is initiated, the first step SP1 in FIG. 8*a* performs initial settings for the chord variation CV, the template TM and the step time ST, namely, the chord variation CV is set at "Lo", the template TM is set at the first performance style "8 beat-1" and the step time ST at "quarter note", as the default values. Then a step SP2 designates the music position at which the composed performance information is to be placed, the designation of the position being made in terms of numerical values indicating the measure, the beat and the clock count (for example: 1st measure, 2nd beat, count "0") as shown at the music position designating site IpA (FIG. 4). The process then moves forward to a step SP3.

(2) Chord Designation and Constituent Notes Representation

The step SP3 reads out from the chord track ChT in the RAM 4 a chord name CH at the timing T which corresponds to the designated music position before moving to a step SP4. The step SP4 displays the read-out chord name CH in the chord name indicating box ChA on the screen of FIG. 4 and displays the chord constituent notes for the chord CH in the chord constituent exhibiting box TcA of FIG. 4. The chord constituent notes are obtained by referring to the table of constituent notes (BT of FIG. 3*a,* or UT of FIG. 3*b*) which is designated by the chord variation CV, and retrieving the chord constituent note data sets TC which corresponds to the above read-out chord name CH. The obtained chord constituent note data set TC causes the chord constituent note representation in the box TcA of FIG. 4.

A step SP5 judges whether a root note RT and a chord type TP are designated by the manipulation of the chord root note designating box RtA and the chord type designating box TyA on the screen of FIG. 4. If the judgment is affirmative (Y), the process goes to a step SP6, and if negative (N), to a step SP8 in FIG. 8*b*. The step SP6 adjusts (if the same, keeps; if different, changes) the chord name CH displayed in the chord name indicating box ChA based on the designated root note RT and chord type TP, and a step SP7 refers to the above table of constituent notes and displays the chord constituent notes for the adjusted chord name CH in the chord constituent note exhibiting box TcA before proceeding to the step SP8 in FIG. 8*b*.

The step SP8 judges whether a chord variation CV is designated in the chord variation designating site CvA on the screen of FIG. 4. If the judgment is affirmative (Y), the process goes to a step SP9, and if negative (N), to a step SP10. The step SP9 refers to the table of constituent notes of the designated chord variation CV and displays the chord constituent notes for the present chord name CH in the chord constituent note exhibiting box TcA, before proceeding to the step SP10.

(3) Template Designation

The step SP10 judges whether a template TM is designated by the template designating key TmK on the keyboard 14 of FIG. 5 or by the chord template designating site TmA on the screen of FIG. 4. If the judgment is affirmative (Y), the process goes to a step SP11, and if negative (N), to a step SP12. The step SP11 puts a designation mark such as an underline to the designated template, before proceeding to the step SP12. An example of the designation is shown in FIG. 4, in which the template name "8 Beat-2" (one of the performance styles) is underlined at the chord template designating site TmA to let the user know the designated template TM is actually under a designated state.

The step SP12 judges whether the play button LB in the screen of FIG. 4 is on or not. If the judgment is affirmative (Y), the process goes to a step SP13, and if negative (N), to a step SP14. The step SP13 generates note data sets NDn based on the designated chord name CH, chord variation CV and template TM, and emits sounds of the tones represented by the note data sets NDn by means of the tone generator circuit 8, the effects circuit 9 and the sound system 17 before proceeding to the step SP14.

(4) Step Time Designation

The step SP 14 judges whether the step time ST is designated by the step time designating key StK on the keyboard 14 of FIG. 5. If the judgment is affirmative (Y), the process goes to a step SP15, and if negative, to a step SP16 shown in FIG. 9, the second half of the process routine for composing performance information under the music position designating mode. The step SP15 updates the step time ST to the designated value, before proceeding to the step SP16 (FIG. 9).

(5) Note Data Generation and Placing

As shown in FIG. 9, the step SP16 judges whether the place button IB on the screen of FIG. 4 is on or not. If the judgment is affirmative (Y), the process goes to a step SP17, and if negative (N), to a step SP18. The step SP17 generates note data sets NDn based on the designated chord name CH, chord variation CV and template TM, and writes the generated note data sets NDn into the note tracks NtTn of the automatic performance information in the RAM 4, before proceeding to the step SP18.

The step SP18 judges whether a string and stroke designating key SpK in the keyboard 14 of FIG. 5 is depressed or not. If the judgment is affirmative (Y), the process goes to a step SP19, and if negative (N), to a step SP20. The step SP19 generates note data sets NDn based on the designated chord name CH and chord variation CV, and on the on-key SpK, and writes the generated note data sets NDn into the note tracks NtTn of the automatic performance information in the RAM, before proceeding to the step SP20.

The step SP20 judges whether a new music position to place further note data sets is going to be designated at the music position designating site IpA of FIG. 4 (i.e. whether the mouse cursor is within the IpA site to change the numerical values for measure, beat and clock). If the judgment is affirmative (Y), the process moves to a step SP21, and if negative (N), to a step SP22. The step SP21 is to designate a new music position (measure, beat, clock) according to the manipulation of the numeral inputting boxes within the music position designating site IpA, before going back to the step SP3 (FIG. 8*a*). In case the user wants to terminate the performance information composing processing under this mode, the user clicks the right-up "close" button. The step SP22 judges whether the close button is on or not. When the judgment is affirmative (Y), the processing comes to its end, and when the judgment is negative (N), the process goes back to the step SP5 (FIG. 8*a*) to repeat the above flow loop until the "close" button becomes on.

Processing in Step-by-Step Recording Mode

Figure 8B:
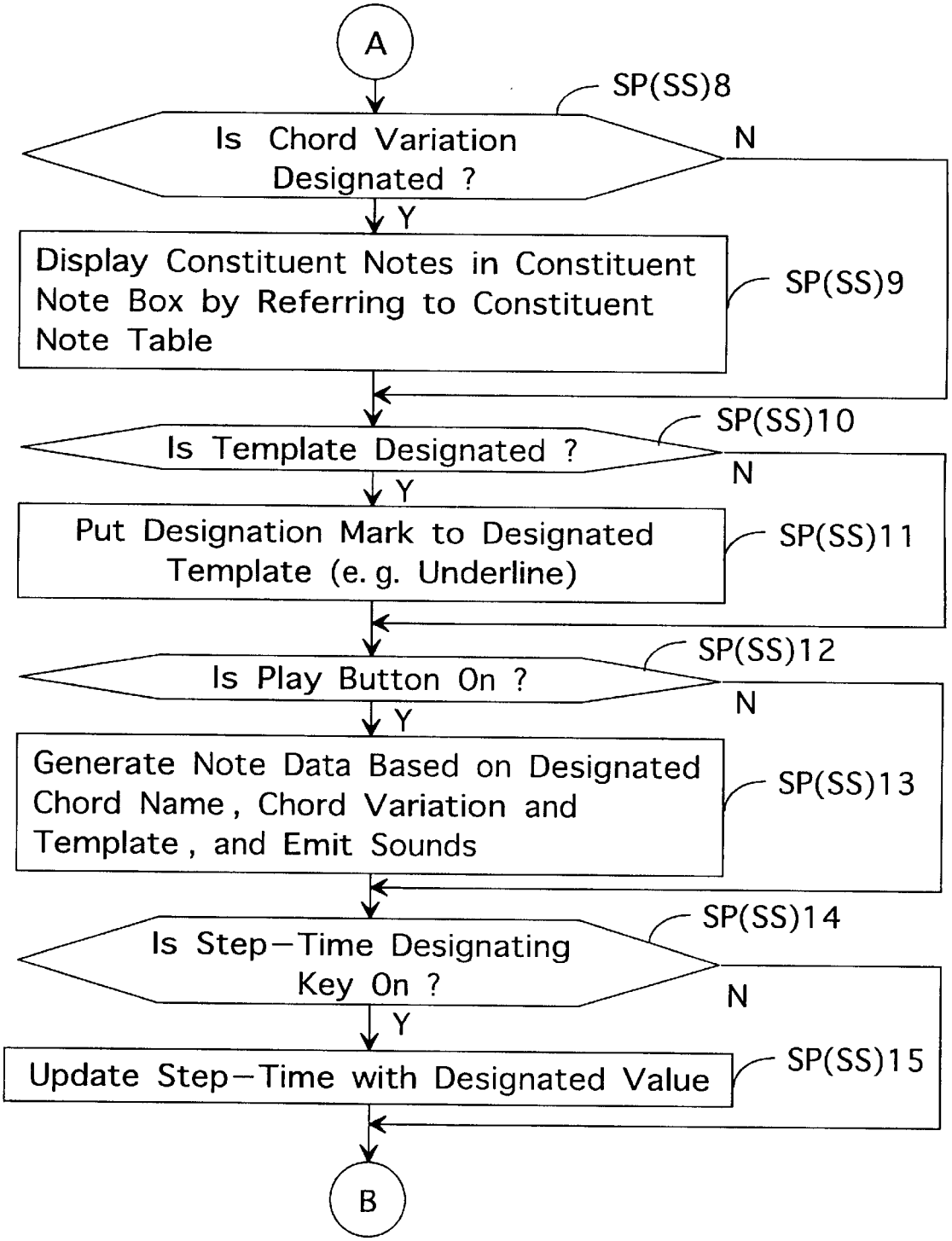

The step-by-step recording mode is a mode in which plural lengths (spans) of stringed musical instrument performance information are generated one after another and are accumulated or connected one after another to compose a longer length of stringed musical instrument performance information. After a length of note data sets NDn are generated, another length of note data sets NDn are generated to be connected to the tail of the preceding length, and so forth. The processing under this mode consist of the flow chart sections of FIGS. 8*a,* 8*b* and 10. FIGS. 8*a* and 8*b* in combination constitute the first half of this mode processing in which each step should be referenced by the legends SSn (n=1, 2, . . . ) as expressed in the parentheses, and FIG. 10 constitutes the second half of this mode processing.

Upon instruction by the user to start the step-by-step recording mode by means of an instruction switch (not shown), the process flow of "composing performance information under the step-by-step recording mode" is initiated. In this processing mode, every time a length (span) of note data sets NDn is generated and recorded, the next starting position for recording is successively shifted by an amount of the preceding length, namely the next starting position (head) is determined at the ending position (tail) of the preceding length, in which every length is determined by the step time ST as designated by the step time designating key StK (FIG. 5) or by the length of the designated template TM (FIG. 6), whereby every recording start position in the music progression (i.e. note track NtTn) is automatically determined according to the preceding length. Thus, there will be no need of designating the music positions using the music position designating site IpA on the display screen shown in FIG. 4, and the manipulation of the apparatus will be easy and moreover the progress of performance can be easily grasped.

As the processing of the step-by-step recording mode is initiated, the first step SS1 in FIG. 8*a* performs initial settings for the chord variation CV, the template TM and the step time ST, namely, the chord variation CV is set at "Lo", the template TM is set at the first performance style "8 beat-1" and the step time ST at "quarter note", as the default values. Then a step SS2 designates the recording position from which the composed performance information is to be recorded, the designation of the position being made in terms of numerical values indicating the measure, the beat and the clock count (for example: 17th measure, 1st beat, count "0") automatically next to the last ending position. The process then moves forward to a step SS3. The processing from the step SS3 through a step SS15 are mutatis mutandis the same as those described above in connection with the music position designating mode with reference to FIGS. 8*a* and 8*b*.

Figure 10:
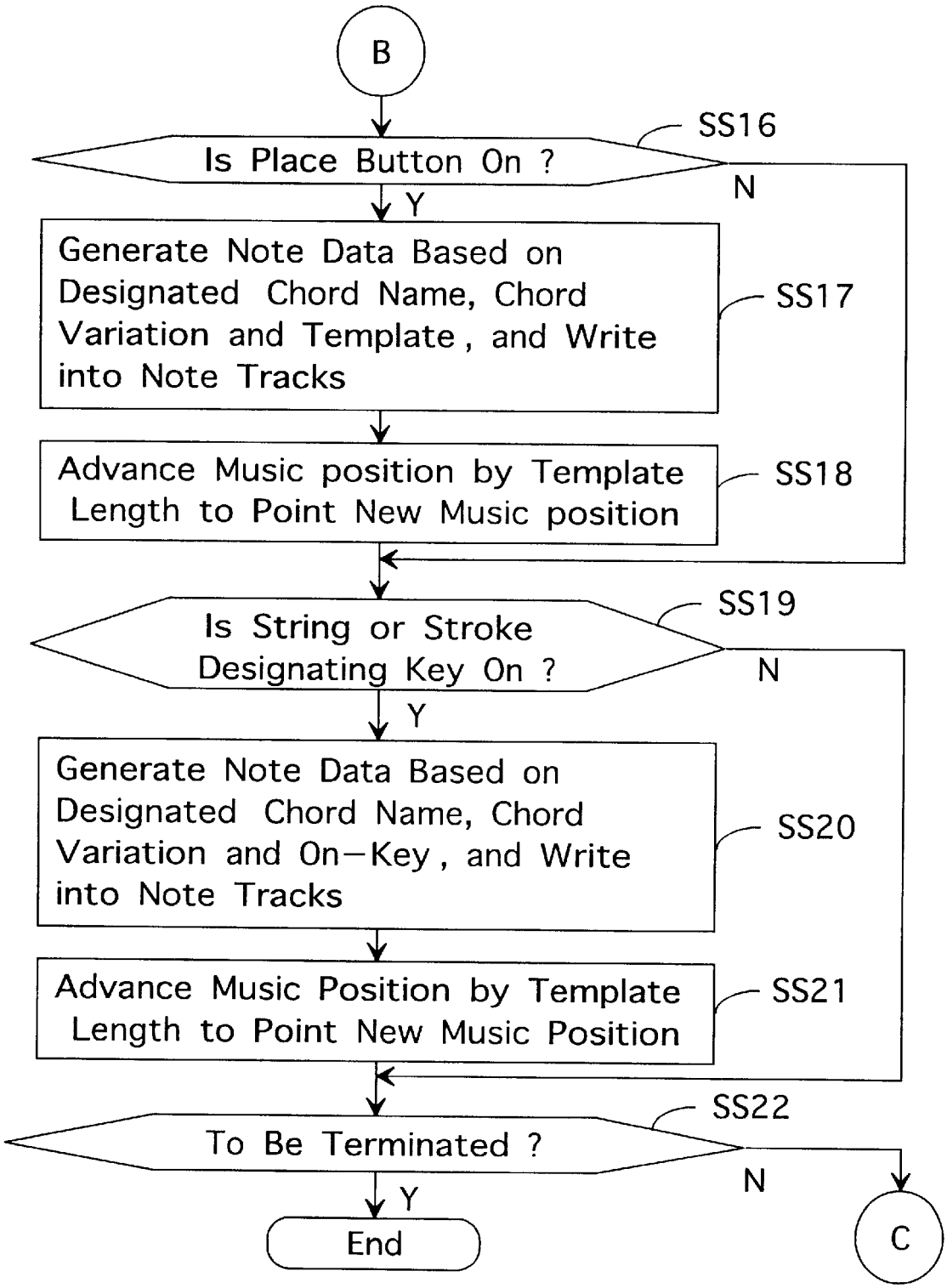
FIG. 10 is a flow chart showing the second half of the process routine for composing performance information under the step-by-step recording mode in the embodiment of the present invention.

Referring to FIG. 10, a step SS16 judges whether the place button IB (FIG. 4) is on or not. When the judgment is affirmative (Y), the process goes to a step SS17, and if negative (N), to a step SS19. The step SS17 generates note data sets NDn based on the designated chord name CH, chord variation CV and template TM, and writes the generated note data sets NDn into the note tracks NtTn of the automatic performance information in the RAM 4. Then, a step SS18 advances the music position (i.e. recording position) by an amount of the template length to point a new music position, before proceeding to the step SS 19.

The step SS19 judges whether a string and stroke designating key SpK (FIG. 5) is depressed or not. If the judgment is affirmative (Y), the process goes to a step SS20, and if negative (N), to a step SS22. The step SS20 generates note data sets NDn based on the designated chord name CH and chord variation CV, and on the on-key SpK, and writes the generated note data sets NDn into the note tracks NtTn of the automatic performance information in the RAM. Then a step SS21 advances the music position by an amount of the template length to point a new music position, before proceeding to the step SS22. The step SS22 asks the user and judges whether the performance information composing processing under this "step-by-step recording mode" is to be terminated or not. When the judgment is affirmative (Y), the processing comes to its end, and when the judgment is negative (N), the process goes back to the step SS5 (FIG. 8*a*).

Processing in Real-Time Recording Mode

Figure 11:
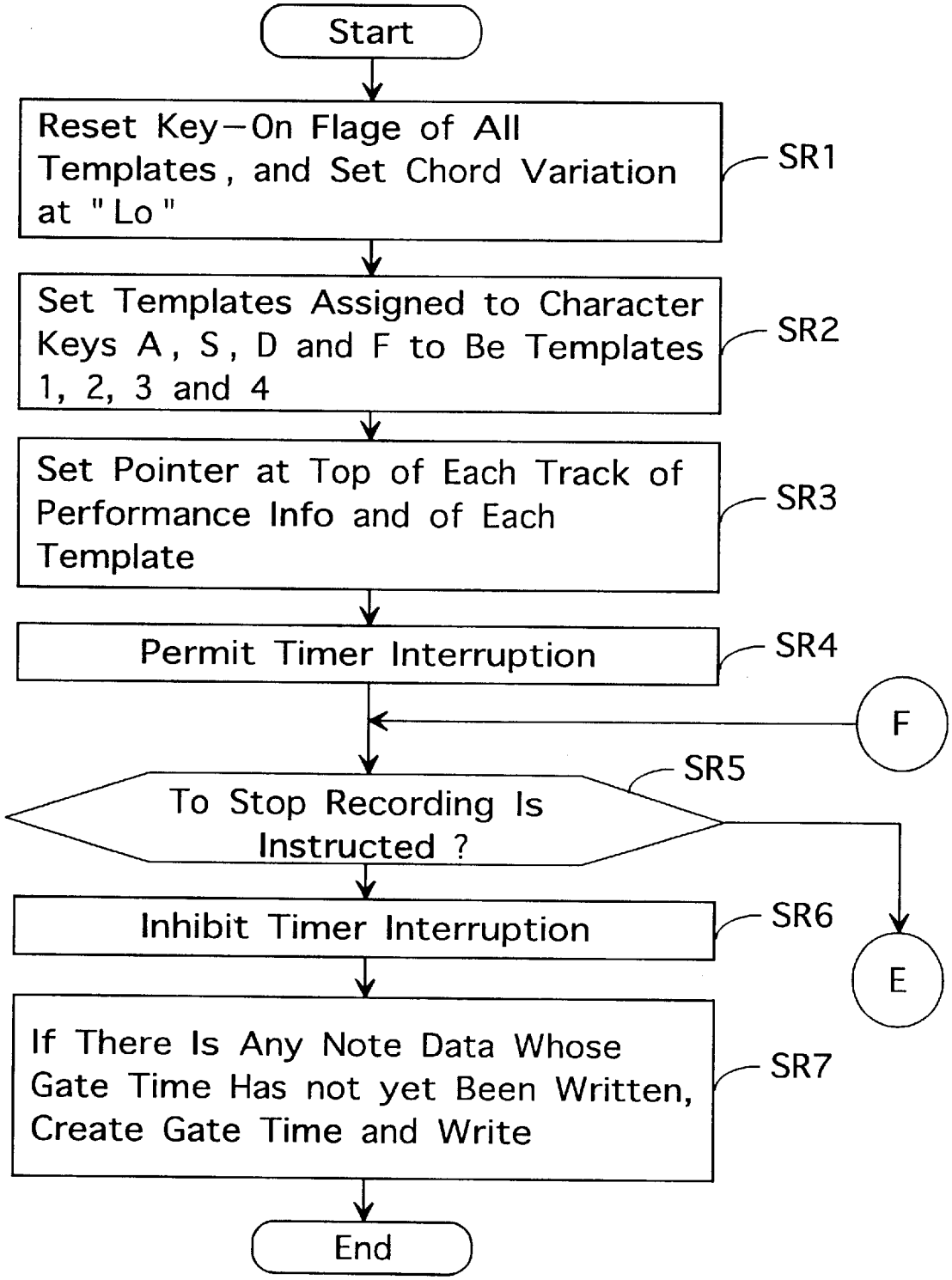
FIG. 11 is a flow chart showing the straight path portion of the process routine for composing performance information under the real-time recording mode in the embodiment of the present invention.
Figure 13A:
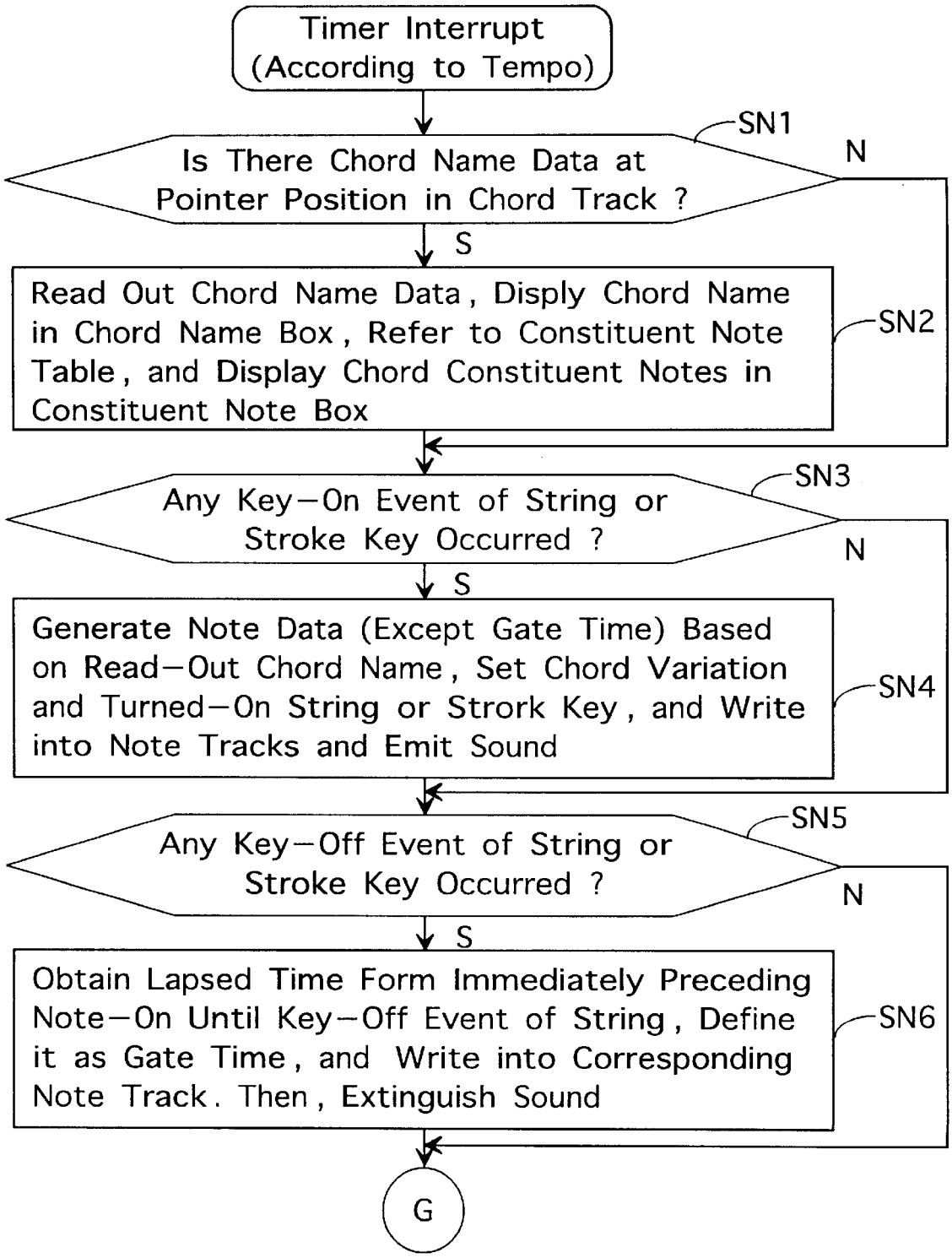
FIGS. 13*a* and 13*b*, in combination, are a flow chart showing the timer interrupt process routine for composing performance information in the embodiment of the present invention.
Figure 13B:
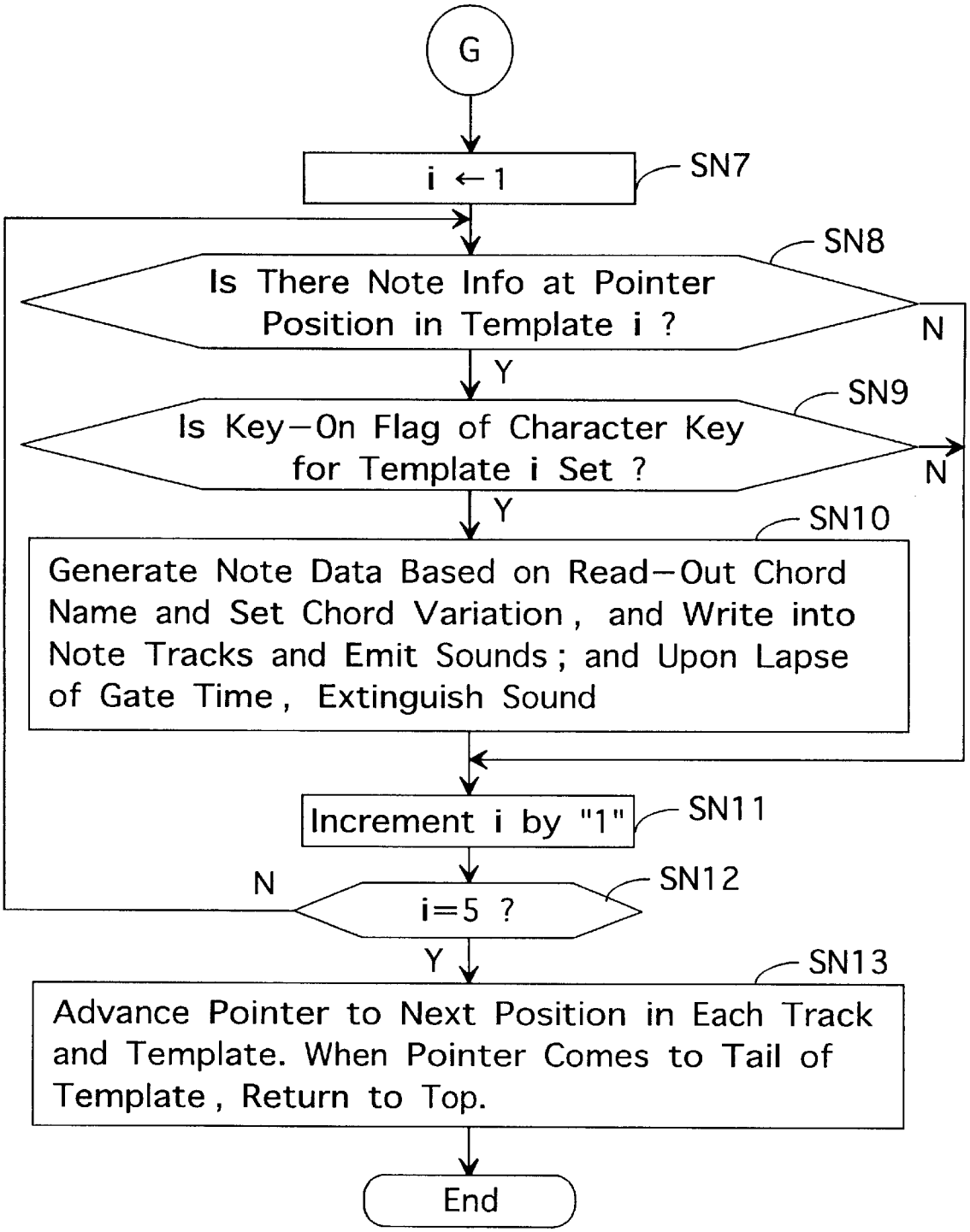

FIGS. 11 and 12 show a flow chart of the process routine for composing performance information under the real-time recording mode. FIGS. 13*a* and 13*b,* in combination, show a flow chart of the timer interrupt process routine to be used in conjunction with the process routine for composing performance information in FIGS. 11 and 12. This mode is a process of successively generating the note data sets NDn in real time according to the manipulations of the operating buttons and elements.

(1) Initial Setting

Upon instruction by the user to start the real-time recording mode by means of an instruction switch (not shown), the first step SR1 in FIG. 11 performs initial settings for the template i (i=1, 2, . . . ) and the chord variation CV, namely, the key-on flags of all the templates i is reset and the chord variation CV is set at "Lo" as its default value. The next step SR2 sets the templates i assigned to the character keys "A", "S", "D" and "F" to be "template 1", "template 2", "template 3" and "template 4". A step SR3 sets the pointer (pointing the recording position) at the top of each of the tracks NtTn and ChT of the automatic performance information stored in the RAM 4 and at the top of each of the templates i, before proceeding to a step SR4.

(2) Timer Interruption

The step SR4 permits timer interruption, which causes the timer interrupt process routine (as described in detail with reference to FIG. 13) to be executed, upon occurrence of the timer interrupt instruction based on the interrupt clock signal from the timer 2 (FIG. 1), and when the timer interrupt process is over, the process moves forward to a step SR5.

(3) Stop Recording

The step SR5 judges whether it is instructed to stop recording. If the judgment is affirmative (Y), the process goes to a step SR6, and if negative (N), to a step SR8 in FIG. 12. The step SR6 inhibits the timer interruption, and if there is any note data set NDn whose gate time has not been written yet, then a step SR7 creates a gate time GTn and writes it in the note track, before ending the processing under this mode.

(4) Key Manipulation

Processes for various manipulated keys are described in the flow chart of FIG. 12. The step SR8 judges whether there is any template designating key TmK in the keyboard 14 of FIG. 5 turned on. If the judgment is affirmative (Y), the process goes to a step SR9, and if negative(N), to a step SR11. The step SR9 resets all set key-on flags, if any. Then a step SR10 sets the key-on flag of the template designating key TmK which was judged as being "on" at the step SR8, before proceeding to a step SR13.

The step SR11 judges whether there is any template designating key TmK turned off. If the judgment is affirmative (Y), the process goes to a step SR12, and if negative (N), to the step SR 13. The step SR12 resets the key-on flag of the turned-off template key TmK, before proceeding to the step SR13.

The step SR13 judges whether there is any string or stroke designating key SpK (FIG. 5) turned on. If the judgment is affirmative (Y), the process goes to a step SR14, and if negative (N), to a step SR16. If there is any other string or stroke designating key SpK which has been on, the step SR14 generates a key-off event of such another key which has been on, in order to avoid an unnecessary attack in tone generation. But in this case, if the new on-key under process (as judged at the step SR13) and such another on-key are both the string designating keys (i.e. numeric keys "1" through "6"), the step SR14 does not generate a key-off event of such another on-key. Then a step SR15 generates a key-on event of the new on-key under process, before going back to the step SR5 of FIG. 11.

When the step SR13 judges that there is no string or stroke designating key SpK turned on, the step SR16 judges whether there is any string or stroke designating key SpK turned off. If the judgment is affirmative (Y), the process goes to a step SR17, and if negative (N), to the step SR5. The step SR17 generates a key-off event of the turned-off key to reset the key-on flag thereof, before going back to the step SR5.

Timer Interrupt Routine

FIGS. 13*a* and 13*b*, in combination, show the timer interrupt processing routine which is permitted at the step SR4 of FIG. 11. The timer interrupt processing is initiated repeatedly at a time interval determined according to the tempo, every time the CPU 1 receives an interrupt clock signal. The time interval depends on the resolution required for the automatic performance, and may be the length which is one twenty-fourth (1/24) of the quarter note duration, namely the frequency of the clock signal is 24 times per quarter note duration.

(1) Displaying Chord Name and Constituent Notes

As the timer interrupt process is initiated at a time interval corresponding to the tempo, the first step SN1 judges whether there is a chord name data CH at the pointer position in the chord track ChT. If the judgment is affirmative (Y), the process goes to a step SN2, and if negative (N), to a step SN3. The step SN2 reads out the chord name data CH and displays the chord name in the chord name indicating box ChA (FIG. 4), and then refers to the chord constituent note table TC under the designated chord variation CV to display the chord constituent notes (chord tones) in the chord constituent note exhibiting box TcA (FIG. 4), before proceeding to the step SN3.

(2) Event Processing for String and Stroke Designating Keys

The step SN3 judges whether there is any key-on event of the string or stroke designating key SpK occurred. If the judgment is affirmative (Y), the process goes to a step SN4, and if negative (N), to a step SN5. The step SN4 generates a note data set NDn except for a gate time GTn based on the read-out chord name CH, the set chord variation CV and the depressed string or stroke key of which the key-on event occurred, and writes the generated note data set NDn into the note track NtTn of the automatic performance information stored in the RAM 4, and then emits sound of the tone generated in the tone generator circuit 8 based on the note data set NDn via the effects circuit 9 and the sound system 17, before proceeding to the step SN5.

The step SN5 judges whether there is any key-off event of the string or stroke key SpK occurred. If the judgment is affirmative (Y), the process goes to a step SN6, and if negative (N), to a step SN7 in FIG. 13*b*. The step SN6 obtains a lapsed time from the immediately preceding note-on until the note-off of the string of which the key-off event occurred, and defines the lapsed time as a gate time GTn for the string, and then writes the gate time GTn into the corresponding note track NtTn, extinguishing the sound. Then, process moves forward to the step SN7.

(3) Scanning Templates

After setting the template number i at "1" in the step SN7, the process goes to a step SN8 to judge whether there is a note sounding data set NIn at the pointer position in the template i. If the judgment is affirmative (Y), the process goes to a step SN9, and if negative (N), to a step SN11. The step SN9 judges whether there is any set key-on flag (as being "on") of the character key among the template designating keys TmK ( "A" through "F" in FIG. 5) corresponding the template i under process. If the judgment is affirmative (Y), the process goes to a step SN10, and if negative (N), to the step SN11.

The step SN10 generates a note data set NDn based on the read-out chord name CH and the set chord variation, and writes the note data set NDn into the corresponding note track NtTn of the automatic performance information in the RAM4, and emits sound. The emitted sound is thereafter extinguished after the lapse of the gate time, before proceeding to the step SN11.

(4) Terminating Interrupt Routine

The step SN11 increments "i" by "1", and then a step SN12 judges whether the template number "i" becomes equal to "5" or not. If the judgment is negative (N), the process goes back to the step SN8 to repeat the processing from the step SN8 through the step SN12 until "i" becomes equal to "5". When the template number "i" reaches "5", the process moves forward to a step SN13 to advance the pointer to the next position in each note track NtTn and in the template i as preparation for the next interrupt, and then the interrupt processing of this time is terminated. When the pointer in the template i comes to the tail of the template data, the pointer is to return to the top of the template data, thus reading in a circle.

Various Alterations

In the above described embodiment, the alphanumeric keys in the typewriter keyboard 14 are assigned to the template designating keys TmK and the string and stroke designating keys SpK, but the designating keys may be provided individually in the form of exclusively assigned keys (buttons) or may be in the form of mouse-clicking buttons on the screen.

The arpeggio template may include a track for "the strings corresponding to the chord root among the 4th through 6th strings (4th+5th+6th string)". This configuration will be advantageous in obtaining a good atmosphere of the genuine guitar arpeggio performance.

The data format of the template TM may not necessarily be the one that the string tracks are provided for the respective strings individually and the note data are recorded on a string-by-string basis as shown in FIGS. 6*a,* 6*b* and 6*c,* but may be the one that the note data of plural (e.g. six) strings are recorded on a single track intermingledly with the string identifying data SRn contained in the note data NIn.

In the music position designating mode and in the step-by-step mode, the pointer position is designated by (1) inputting numerical values of the measure, the beat and the clock count as shown at the music position designating site IpA in FIG. 4, but may be by (2) rendering the automatic performance running and stopping the automatic performance at an intended position, or by (3) exhibiting on the display screen an automatic performance notation in the form of notes and rests on the five-line stave, or of a piano roll pattern, or of an event list pattern, and clicking the intended position on the screen using the mouse 15. Further modifications may be possible.

The tracks for recording the generated note data NDn of the respective strings may be selectively designated by the user from among a number of tracks provided or may be blank tracks automatically hunted by the CPU 1. The note data NDn may be recorded on the separate tracks NtTn for separate strings on a string-by-string basis as illustrated in FIG. 7, or alternatively the note data NDn of all the strings may be recorded on a single track in an intermingled fashion.

In performing the real-time recording mode using the template i, the embodiment employs the method in which the processing starts reading out all the templates upon initiation of recording and the note data NDn generated while the template designating key TmK is depressed are written on the note tracks NtTn. This method serves to coincide the beats of the automatic performance data PD being recorded with the beats of the template i. An alternative method may be that the processing starts reading out the template i from its top in response to the depression of the template designating key TmK and stops reading out in response to the release of the key TmK. This method may cause discrepancy between the beats of the recorded automatic performance data PD and the beats of the template i, but such discrepancy may serve to record the note data in an anomalous rhythm.

In the embodiment, the processing stops recording the note data NDn upon release of the template designating key TmK (step SR12), but the processing may be designed such that the note sounding data NIn from the same template i are kept being recorded until another template designating key TmK is depressed successively. In the latter case, the note sounding data may not be recorded, but may be merely sounded in audible sounds.

There may be provided templates of different meters such as triple meter and quadruple meter, and such may be selectively used according to the intended performance information to be recorded. The template may be made by the user.

While the invention is described about the embodiment which composes performance information of the guitar, but the invention is also applicable to the double bass, the ukulele, the mandolin and other stringed musical instruments. For such purposes, templates are preferably different for different instrument from the viewpoint of the number of strings and the chord constituent notes (chord tone structure). It will be also preferable, if the categories of template, the number of strings and the chord tone structures are selectable according to the tone colors.

Advantages

According to the present invention, different strings and manipulating manners (strokes) are allotted to a plurality of manipulating elements (keys, buttons), the note pitches of the respective strings are determined according to the designated chord, and the note data are generated for the individual strings and strokes corresponding to the depressed manipulating elements. And therefore, even a user who cannot play the actual guitar or the like stringed musical instrument can compose performance information which gives a real guitar-like performance feeling by easy manipulation of the keys.

Further, according to the present invention, templates are provided for the cutting play and the arpeggio play, the note pitches of the respective strings are determined according to the designated chord, and the note data are generated for the individual strings at the timings indicated in the template. And therefore, the composed performance information reflects particular voicings which are unique to the poly-chord stringed instrument like a guitar and can play back the realistic performance as on the actual stringed instrument like a guitar.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. A musical performance information composing apparatus for composing performance information which represents a musical performance on a stringed instrument having a plurality of strings, each string being capable of generating a tone having a pitch which is selectively assigned to said each string from among plural pitches available on said each string, said apparatus comprising:

a chord designating device which designates a chord;

a tone pitch determining device which determines pitches of tones to be respectively assigned to said plurality of strings such that the tones of said determined pitches constitute said designated chord;

a string and timing designating device which designates strings to be assigned for tone generation from among said plurality of stings and designates a timing for each of said designated strings at which timing the assigned tone is to be generated; and a tone data generating device which generates tone data of the tones having said determined pitches, the data of each tone representing the tone generation on the string and at the timing as designated by said string and timing designating device.

2. A musical performance information composing apparatus as claimed in claim 1, wherein said string and timing designating device comprises a plurality of manipulating elements, each of which is individually assigned to each of said plurality of strings.

3. A musical performance information composing apparatus as claimed in claim 2, wherein said string and timing designating device further comprises a plurality of manipulating elements, each of which is assigned to a manner of playing plural strings in combination.

4. A musical performance information composing apparatus as claimed in claim 1, wherein said string and timing designating device comprises a storage device which stores at least one template defining a generation timing of each tone assigned to each of said strings.

5. A method for composing performance information which represents a musical performance on a stringed instrument having a plurality of strings, each string being capable of generating a tone having a pitch which is selectively assigned to said each string from among plural pitches available on said each string, said method comprising the steps of:

designating a chord;

determining pitches of tones to be respectively assigned to said plurality of strings such that the tones of said determined pitches constitute said designated chord;

designating strings to be assigned for tone generation from among said plurality of strings, and designating a timing for each of said designated strings at which timing the assigned tone is to be generated; and generating tone data of the tones having said determined pitches, the data of each tone representing the tone generation on the string and at the timing as designated by said step of designating strings and a timing.

6. A machine readable medium for use in an apparatus for composing performance information which represents a musical performance on a stringed instrument having a plurality of strings, each string being capable of generating a tone having a pitch which is selectively assigned to said each string from among plural pitches available on said each string, said apparatus being of a data processing type comprising a computer, said medium containing program instructions executable by said computer for executing:

a process of designating a chord;

a process of determining pitches of tones to be respectively assigned to said plurality of strings such that the tones of said determined pitches constitute said designated chord;

a process of designating strings to be assigned for tone generation from among said plurality of strings, and designating a timing for each of said designated strings at which timing the assigned tone is to be generated; and a process of generating tone data of the tones having said determined pitches, the data of each tone representing the tone generation on the string and at the timing as designated by said process of designating strings and a timing.

* * * * *